US007653539B2

(12) United States Patent
Yamanashi et al.

(10) Patent No.: US 7,653,539 B2
(45) Date of Patent: Jan. 26, 2010

(54) COMMUNICATION DEVICE, SIGNAL ENCODING/DECODING METHOD

(75) Inventors: Tomofumi Yamanashi, Tokyo (JP); Kaoru Sato, Kanagawa (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 656 days.

(21) Appl. No.: 10/590,417

(22) PCT Filed: Feb. 22, 2005

(86) PCT No.: PCT/JP2005/002764

§ 371 (c)(1),
(2), (4) Date: Oct. 30, 2006

(87) PCT Pub. No.: WO2005/081232

PCT Pub. Date: Jan. 9, 2005

(65) Prior Publication Data

US 2008/0167865 A1 Jul. 10, 2008

(30) Foreign Application Priority Data

Feb. 24, 2004 (JP) ..... 2004-048569

(51) Int. Cl.
*G10L 21/02* (2006.01)

(52) U.S. Cl. ..... 704/226; 704/229; 704/500; 704/501; 704/503; 704/504

(58) Field of Classification Search ..... 704/226, 704/229, 500, 501, 503, 504
See application file for complete search history.

(56) References Cited

U.S. PATENT DOCUMENTS 6,125,179 A * 9/2000 Wu ..... 379/388.01
6,201,796 B1 * 3/2001 Agazzi et al. ..... 370/286
6,760,435 B1 * 7/2004 Etter et al. ..... 379/406.01
6,898,566 B1 * 5/2005 Benyassine et al. ..... 704/226
2004/0064309 A1 4/2004 Kosai

FOREIGN PATENT DOCUMENTS

| | | |
|---|---|---|
| EP | 0 996 112 | 4/2000 |
| JP | 10-341162 | 12/1998 |
| JP | 11331936 | 11/1999 |

(Continued)

OTHER PUBLICATIONS

PCT International Search Report dated Jun. 7, 2005.

(Continued)

*Primary Examiner*—Qi Han
(74) *Attorney, Agent, or Firm*—Dickinson Wright, PLLC

(57) ABSTRACT

There is provided a communication device for effectively encoding an audio/music signal while maintaining a predetermined quality by controlling the transmission bit rate of the transmission side considering the use environment of the reception side. In this device, a transmission mode decision unit (101) detects an environment noise contained in the background of the audio/music signal in the input signal and decides the transmission mode controlling the transmission bit rate of the signal transmitted from a communication terminal device (150), which is a communication terminal of the partner side, according to the environment noise level. A signal decoding unit (103) decodes encoded information transmitted from the communication terminal device (150) via a transmission path (110) and outputs the obtained signal as an output signal. Here, the signal decoding unit (103) detects a transmission error by comparing the transmission mode information contained in the encoded information outputted from the transmission path (110), to the transmission mode information obtained by the transmission mode decision unit (101) while considering the transmission delay.

6 Claims, 19 Drawing Sheets

FOREIGN PATENT DOCUMENTS

| | | |
|---|---|---|
| JP | 2000-124915 | 4/2000 |
| JP | 2000244384 | 9/2000 |
| JP | 2003218781 | 7/2003 |

OTHER PUBLICATIONS

ANSI/TIA/EIA-96-C, ARIB STD-T64-C.S0009-0. "Speech Service Option Standard for Wideband Spread Spectrum Digital Cellular System," 1998, pp. i-xiii & 1-73 & A-1-A-2.

Supplementary Search Report dated Jan. 26, 2007.

Bruhn S. et al., "Concepts and Solutions for Link Adaptation and Inband Signaling for the GSM ARM Speech Coding Standard," 1999 IEEE 49$^{th}$, Vehicular Technology Conference, New York, NY, vol. 3, conf. 49, XP000936252, May 16, 1999, pp. 2451-2455.

Japanese Office Action dated Sep. 1, 2009.

* cited by examiner

COMMUNICATION DEVICE, SIGNAL ENCODING/DECODING METHOD

TECHNICAL FIELD

The present invention relates to a communication apparatus and signal coding/decoding method for when speech/audio signals are transmitted in a packet communication system typified by Internet communication, mobile communication system or the like.

BACKGROUND ART

When a speech/audio signal is transmitted using a packet communication system represented by an Internet communication or mobile communication system, a compression/coding technology is often used to enhance transmission efficiency of the speech/audio signal. Furthermore, with regard to multiplexing of signals, the smaller the transmission bit rate of each communication terminal, the more communications can be multiplexed, and therefore for many subscribers to simultaneously communicate, it is desirable to adopt a technique that reduces a transmission bit rate of each communication terminal and enhance the efficiency of channels.

In this respect, there are conventionally disclosed technologies for reducing a transmission bit rate in a communication terminal and base station by acquiring information such as the number of simultaneously accessing users, call loss rate, access waiting time, BER (Bit Error Rate), SIR (Signal Interference Ratio), selecting an appropriate mode from among a plurality of predetermined communication modes according to the information acquired and carrying out communication (e.g., Patent Document 1).

Furthermore, a technique of detecting the presence/absence of speech of a speaker and controlling a transmission bit rate according to its detection result, is also developed. For example, Non-patent Document 1 discloses a technology of detecting the presence/absence of speech of a speaker, transmitting data coded at a high bit rate for a period during which the speaker is speaking (voiced period), coded at a low bit rate for a period during which the speaker is not speaking (unvoiced period) so as to reduce the overall transmission bit rate (e.g., Non-patent Document 1).

Patent Document 1 Japanese Patent Application Laid-Open No. 11-331936

Non-patent Document 1: ANSI/TIA/EIA-96-C, Speech Service Option Standard for Wideband Spread Spectrum Digital Cellular System

DISCLOSURE OF INVENTION

Problems to be Solved by the Invention

However, the above described conventional speech/music coding/decoding method only performs such control as to lower a transmission bit rate when silence continues for a certain time during a conversation as one of elements of the communication environment on the transmitting side and gives no consideration to the operating environment on the receiving side, and therefore it has a problem that efficient transmission is not possible.

It is therefore an object of the present invention to provide a communication apparatus and signal coding/decoding method capable of performing efficient coding on speech/audio signals while maintaining predetermined quality by controlling a transmission bit rate on the transmitting side with the operating environment on the receiving side taken into consideration.

Means for Solving the Problem

The communication apparatus according to the present invention adopts a configuration comprising a transmission mode determining section that determines a transmission mode for controlling a transmission bit rate of a signal transmitted from an apparatus of the communicating party according to a level of ambient noise included in an input signal and transmits the transmission mode to the apparatus of the communicating party and a decoding section that decodes an information source code obtained by coding the input signal at a transmission bit rate corresponding to the transmission mode at the apparatus of the communicating party based on the transmission mode transmitted from the apparatus of the communicating party.

The communication apparatus of the present invention adopts a configuration comprising a transmission mode determining section that determines a first transmission mode for controlling a transmission bit rate of a signal transmitted from the communication apparatus according to a level of ambient noise included in an input signal of an apparatus of the communicating party and a second transmission mode for controlling a transmission bit rate of an input signal of the communication apparatus based on a level of ambient noise included in the input signal of the communication apparatus and a coding section that performs coding on the input signal at the transmission bit rate corresponding to the second transmission mode and transmits an information source code obtained through the coding and the second transmission mode to the apparatus of the communicating party.

The communication apparatus according to the present invention adopts a configuration comprising a decoding section that decodes an information source code obtained through coding by an apparatus of the communicating party, a transmission mode determining section that determines a transmission mode for controlling a transmission bit rate of an input signal according to a level of ambient noise of the signal decoded by the decoding section and a coding section that performs coding on the input signal at a transmission bit rate corresponding to the transmission mode determined by the transmission mode determining section and transmits the information source code obtained through the coding and the transmission mode to the apparatus of the communicating party.

The communication apparatus according to the present invention adopts a configuration comprising a decoding section that decodes an information source code obtained through coding by an apparatus of the communicating party, a transmission mode determining section that determines a transmission mode for controlling a transmission bit rate of the input signal based on a level of ambient noise included in an input signal and a level of ambient noise of the signal decoded by the decoding section and a coding section that performs coding on the input signal at a transmission bit rate corresponding to the transmission mode determined by the transmission mode determining section and transmits the information source code obtained through the coding and the transmission mode to the apparatus of the communicating party.

The communication apparatus according to the present invention adopts a configuration comprising a transmission mode determining section that determines a transmission mode for controlling a transmission bit rate of a signal transmitted from an apparatus of the communicating party according to a level of ambient noise included in an input signal and transmits the transmission mode to the apparatus of the communicating party and a decoding section that decodes an information source code obtained by coding the input signal at a transmission bit rate corresponding to the transmission mode by the apparatus of the communicating party based on the transmission mode determined by the transmission mode determining section.

The signal coding/decoding method according to the present invention is a signal coding/decoding method whereby a first communication apparatus and a second communication apparatus carry out a radio communication, the second communication apparatus transmits an information source code obtained by coding an input signal to the first communication apparatus and the first communication apparatus decodes the information source code, comprising a step by the first communication apparatus of determining a transmission mode for controlling a transmission bit rate of a signal transmitted from the second communication apparatus according to a level of ambient noise included in the input signal and transmitting the transmission mode to the second communication apparatus, a step by the second communication apparatus of coding the input signal at a transmission bit rate corresponding to the transmission mode determined by the first communication apparatus and transmitting the information source code obtained through the coding to the first communication apparatus and a step by the first communication apparatus of decoding the information source code at the transmission bit rate transmitted from the second communication apparatus.

The signal coding/decoding method according to the present invention comprises a step of determining a transmission mode for controlling a transmission bit rate of a signal transmitted from an apparatus of the communicating party according to a level of ambient noise included in an input signal and transmitting the transmission mode to the apparatus of the communicating party and a step by the apparatus of the communicating party of decoding an information source code obtained by coding the input signal at a transmission bit rate corresponding to the transmission mode based on the transmission mode transmitted from the apparatus of the communicating party.

The signal coding/decoding method according to the present invention comprises a step by an apparatus of the communicating party of decoding an information source code obtained through coding, a step of determining a transmission mode for controlling a transmission bit rate of an input signal according to a level of ambient noise of the decoded signal and a step of coding the input signal at a transmission bit rate corresponding to the determined transmission mode and transmitting the information source code obtained through the coding and the transmission mode to the apparatus of the communicating party.

Advantageous Effect of the Invention

When noise of cars or trains exists on the receiving side, the present invention determines a bit rate on the transmitting side using a masking effect of ambient noise on the receiving side to allow the transmitting side to communicate at a minimum transmission bit rate within a range not influencing human auditory sense, and can thereby substantially improve channel efficiency.

BEST MODE FOR CARRYING OUT THE INVENTION

An audio coding scheme represented by MP3 (Mpeg-1 Audio Layer-3) and AAC (Advanced Audio Coding) realizes efficient coding by using an auditory masking effect and realizing quantization such that quantization errors during coding for each band falls to or below a masking level calculated from an audio signal to be coded. The "auditory masking effect" refers to the phenomenon where the presence of high energy component of a certain frequency "masks" and makes low energy components of neighboring frequencies inaudible.

Figure 1:
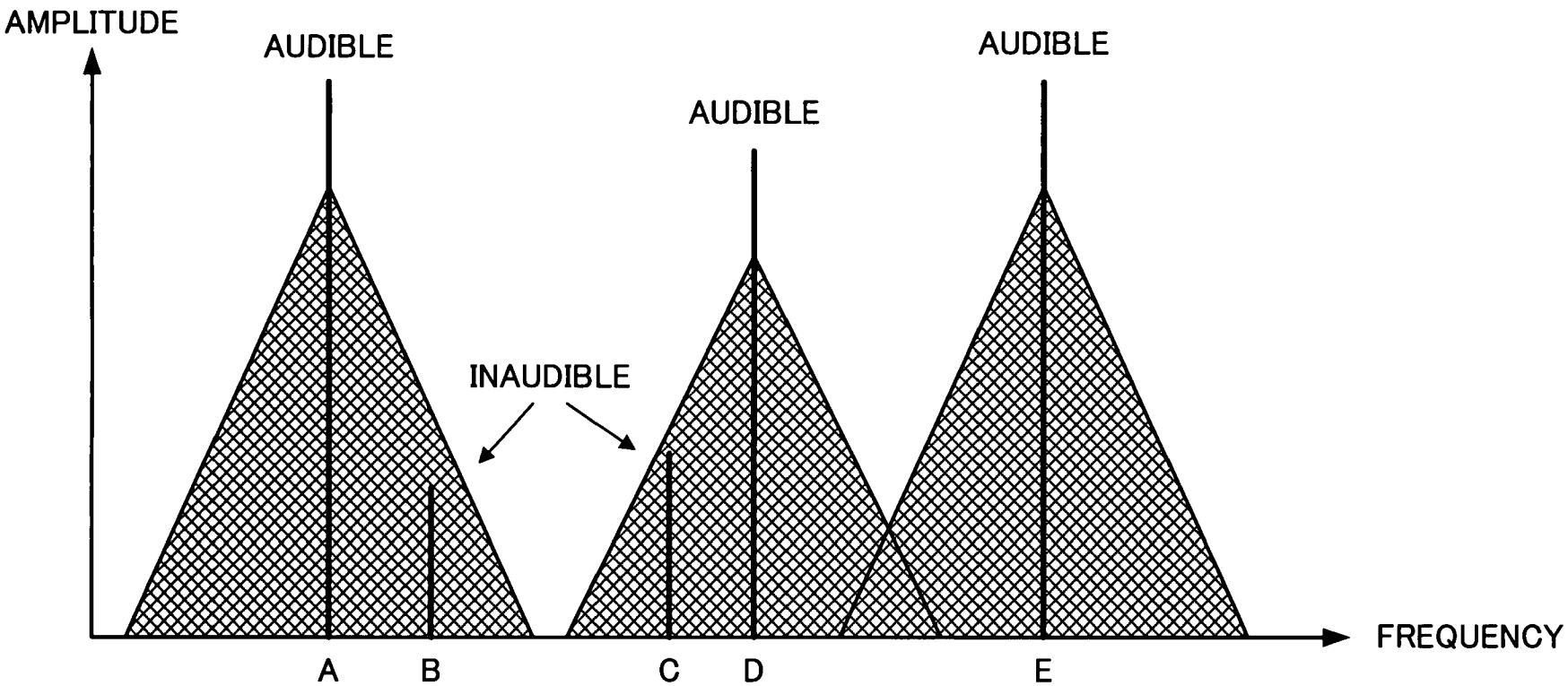
FIG. 1 illustrates an auditory masking effect.

FIG. 1 illustrates an auditory masking effect. Component B and component C in FIG. 1 are masked by component A and component D and cannot be auditorily sensed. Therefore, even when masked components such as component B and component C are reduced a great deal, such a reduction is not perceived. Furthermore, even when a high energy component (large component in the triangular area in FIG. 1) is subjected to rough quantization during coding, such a component is characterized in that its errors (quantization errors) are hardly perceptible to the human ear.

The present invention applies a relationship between an auditory masking effect which is often used in an audio coding scheme and quantization errors during coding to ambient noise and controls a transmission bit rate based on the masking level of the ambient noise.

With reference now to the attached drawings, embodiments of the present invention will be explained in detail below.

EMBODIMENT 1

Embodiment 1 will explain a speech/music coding/decoding method whereby a transmission mode is determined with an auditory masking effect of ambient noise taken into consideration and a transmission bit rate is controlled in a bidirectional communication between communication terminals.

Figure 2:
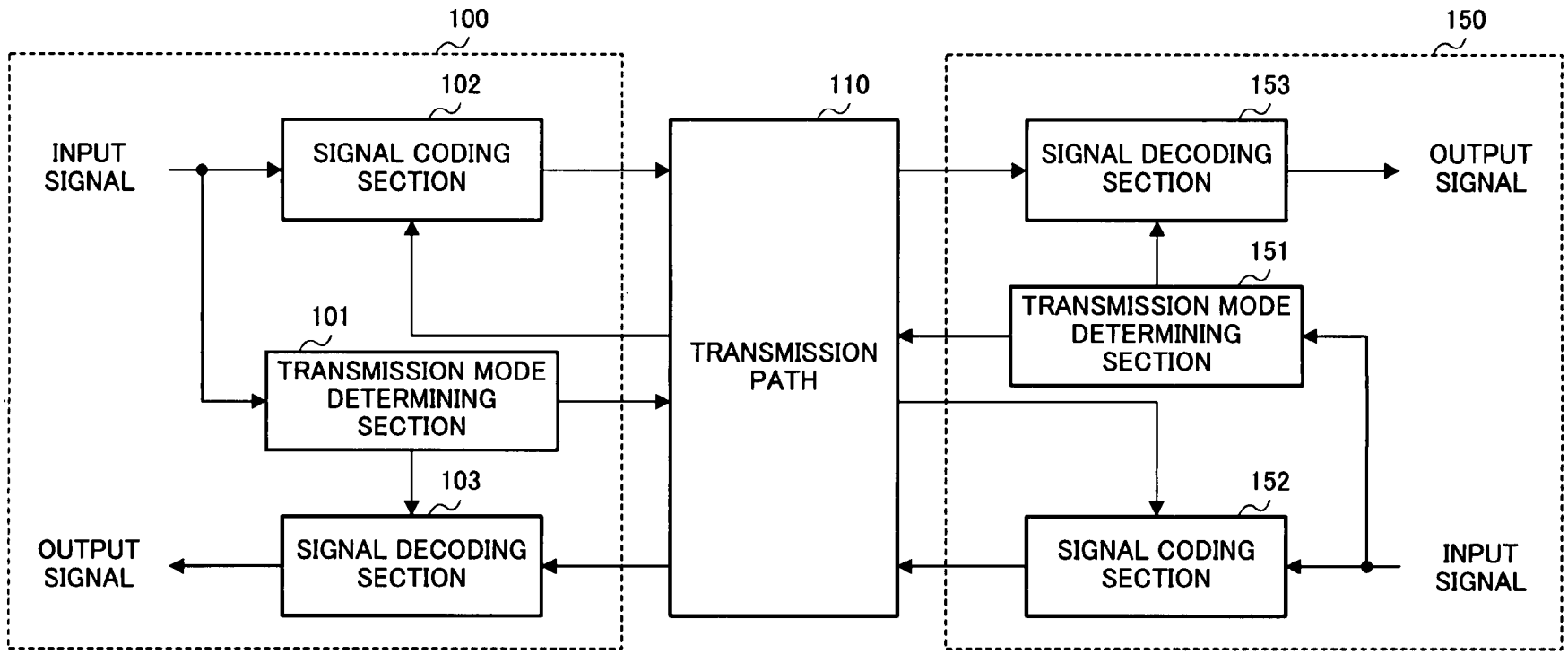
FIG. 2 is a block diagram showing the configuration of a communication terminal apparatus according to Embodiment 1 of the present invention.

FIG. 2 is a block diagram showing the configuration of a communication terminal apparatus according to Embodiment 1. In FIG. 2, suppose a bidirectional communication is carried out between two communication terminal apparatuses 100 and 150.

First, the configuration of communication terminal apparatus 100 will be explained. Communication terminal apparatus 100 is mainly constructed of transmission mode determining section 101, signal coding section 102 and signal decoding section 103.

Transmission mode determining section 101 detects ambient noise included in the background of a speech/audio signal in an input signal and determines a transmission mode for controlling a transmission bit rate of a signal transmitted from communication terminal apparatus 150, which is the communication terminal of the communicating party, according to the level of ambient noise. Transmission mode determining section 101 outputs information indicating the determined transmission mode (hereinafter referred to as "transmission mode information") to transmission path 110 and signal decoding section 103. In an example of this embodiment, suppose that one transmission bit rate is selected from two or more predetermined transmission bit rates and the transmission mode information can take three types of transmission bit rate values; bitrate 1, bitrate 2, bitrate 3 (bitrate 3<bitrate 2<bitrate 1).

Signal coding section 102 performs coding on the input signal which is a speech/audio signal according to the transmission mode information transmitted from communication terminal apparatus 150 through transmission path 110 and outputs the obtained coded information to transmission path 110.

Signal decoding section 103 decodes coded information transmitted from communication terminal apparatus 150 through transmission path 110 and outputs the obtained signal as an output signal. Signal decoding section 103 compares the transmission mode information included in the coded information output from transmission path 110 with the transmission mode information obtained from transmission mode determining section 101 with a transmission delay taken into consideration, and can thereby detect transmission errors. To be more specific, when the transmission mode information obtained from transmission mode determining section 101 with a transmission delay taken into consideration is different from the transmission mode information included in the coded information output from transmission path 110, signal decoding section 103 decides that a transmission error has occurred in transmission path 110. Furthermore, it is also possible to adopt a technique whereby signal coding section 152 of communication terminal apparatus 150 does not integrate the transmission mode information with the coded information, while signal decoding section 103 decodes the coded information output from transmission path 110 using the transmission mode information obtained from transmission mode determining section 101.

Next, the configuration of communication terminal apparatus 150 will be explained. Communication terminal apparatus 150 is mainly constructed of transmission mode determining section 151, signal coding section 152 and signal decoding section 153.

Transmission mode determining section 151 is fed an input signal, detects ambient noise included in the background of a speech/audio signal and determines a transmission mode for controlling a transmission bit rate of a signal transmitted from communication terminal apparatus 100 according to the level of ambient noise. Next, transmission mode determining section 151 outputs the transmission mode information indicating the determined transmission mode to transmission path 110 and signal decoding section 153.

Signal coding section 152 is fed the transmission mode information transmitted from communication terminal apparatus 100 through transmission path 110, performs coding on the input signal which is a speech/audio signal according to the transmission mode information and outputs the obtained coded information to transmission path 110.

Signal decoding section 153 is fed the coded information transmitted from communication terminal apparatus 100 through transmission path 110 and the transmission mode information obtained from transmission mode determining section 151, decodes the coded information and outputs the obtained signal as an output signal. By comparing the transmission mode information included in the coded information output from transmission path 110 with the transmission mode information obtained from the transmission mode determining section 151 with a transmission delay taken into consideration, signal decoding section 153 can detect transmission errors. To be more specific, when the transmission mode information obtained from transmission mode determining section 151 with a transmission delay taken into consideration is different from the transmission mode information included in the coded information output from transmission path 110, signal decoding section 153 decides that a transmission error has occurred in transmission path 110. Furthermore, it is also possible to adopt a technique whereby signal coding section 102 of communication terminal apparatus 100 does not integrate the transmission mode information with the coded information and signal decoding section 153 decodes the coded information output from transmission path 110 using the transmission mode information obtained from transmission mode determining section 151.

Next, the internal configuration of transmission mode determining section 101 in FIG. 2 will be explained using FIG. 3. The configuration of transmission mode determining section 151 in FIG. 2 is the same as that of transmission mode determining section 101.

Transmission mode determining section 101 is mainly constructed of masking level calculation section 301 and transmission mode decision section 302.

Masking level calculation section 301 calculates a masking level from the input signal and outputs the calculated masking level to transmission mode decision section 302.

Transmission mode decision section 302 compares the masking level output from masking level calculation section 301 with a predetermined threshold and determines a transmission bit rate based on the comparison result. To be more specific, when the level of ambient noise existing in communication terminal apparatus 100 detected by communication terminal apparatus 100 is large and its masking level is large, the transmission bit rate is decreased. This is based on a principle that a quantization error of the coded information transmitted from communication terminal apparatus 150 is masked to a certain extent through an auditory masking effect of ambient noise, and, therefore, even when transmission bit rate is lowered at communication terminal apparatus 150, a decoded signal is obtained in equal auditory quality to the case where the transmission bit rate is not lowered. On the other hand, when the level of ambient noise existing on the communication terminal apparatus 100 side detected by communication terminal apparatus 100 is small, the quantization error of the coded information transmitted from communication terminal apparatus 150 is not masked by the auditory masking effect of ambient noise, and therefore the transmission bit rate is increased.

Transmission mode decision section 302 outputs the transmission mode information indicating the determined transmission mode to transmission path 110 and signal decoding section 103.

Here, the processing of masking level calculation section 301 and transmission mode decision section 302 in the case will explained where a method is adopted whereby transmission mode determining section 101 calculates a maximum value and minimum value of the power value of the input signal for a predetermined period of time (e.g., a certain period of approximately 5 seconds to 10 seconds), decides the level of ambient noise included in the input signal from the maximum value and minimum value and the bit rate is controlled according to the level. Here, a case where processing of deciding and outputting the level of ambient noise is carried out every time a frame is processed will be explained, but, in addition to this, it is also possible to perform subsequent processing with pressing of a button by the user of the communication terminal as a trigger or perform subsequent processing at certain time intervals. Furthermore, it is also possible to detect the level of ambient noise at certain time intervals and perform subsequent processing when the difference between the detected level of ambient noise and the previous detected level exceeds a predetermined threshold.

First, the processing of masking level calculation section 301 will be explained. Masking level calculation section 301 divides the input signal into groups of N samples (N: natural number), regards each interval as 1 frame and performs processing in frame units. Hereinafter, the input signal to be coded will be expressed as $x_n$ (n=0, . . . , N−1).

Furthermore, masking level calculation section 301 includes buffers $buf_i$ (i=0, . . . , $N_i$−1). Here, $N_i$ denotes a predetermined non-negative integer, which depends on the number of samples N of 1 frame and when a 1-frame interval is on the order of approximately 20 milliseconds, it is confirmed that desired performance can be obtained when $N_i$ is a value on the order of 100 to 500.

Next, masking level calculation section 301 will calculate frame power Pframe of the frame to be processed from Equation 1 below:

[Equation 1]

$$Pframe = \sum_{n=0}^{N-1} |x_n|^2 \tag{1}$$

Next, masking level calculation section 301 substitutes frame power Pframe calculated from Equation 1 into buffer $buf_{Ni-1}$.

Next, masking level calculation section 301 calculates minimum value $Pframe_{MIN}$ and maximum value $Pframe_{MAX}$ of frame power Pframe in an i interval (interval length $N_i$) and outputs $Pframe_{MIN}$, $Pframe_{MAX}$ to transmission mode decision section 302.

Next, masking level calculation section 301 updates buffer $buf_i$ according to Equation 2 below.

[Equation 2]

$$buf_i = buf_{i+1} \ (i=0, \ldots N_i-2) \tag{2}$$

Figure 3:
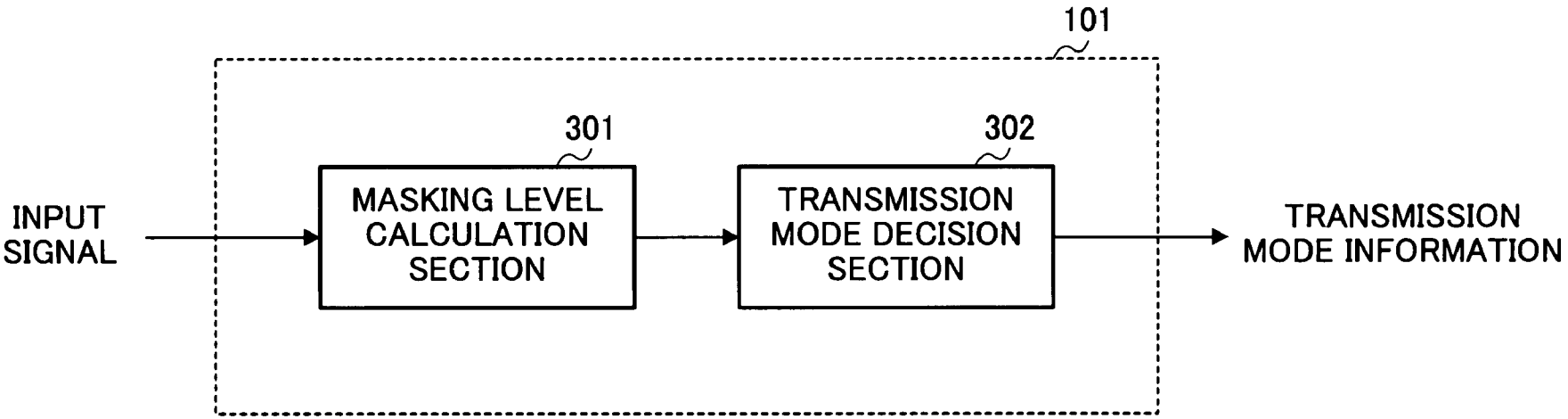
FIG. 3 is a block diagram showing the internal configuration of the transmission mode determining section of the communication terminal apparatus according to the above described embodiment.

This is the explanation of the processing by masking level calculation section 301 in FIG. 3.

Next, the processing of transmission mode decision section 302 will be explained. Transmission mode decision section 302 determines transmission mode information mode from $Pframe_{MIN}$, $Pframe_{MAX}$ output from masking level calculation section 301, according to Equation 3 below:

[Equation 3]

$$\text{Mode} = \begin{cases} bitrate_1 & (Th_0 \le Pframe_{MAX} / Pframe_{MIN}) \\ bitrate_2 & (Th_1 \le Pframe_{MAX} / Pframe_{MIN} < Th_0) \\ bitrate_3 & (Pframe_{MAX} / Pframe_{MIN} < Th_1) \end{cases} \tag{3}$$

where $Th_0$ and $Th_1$ ($Th_0 < Th_1$) are constants predetermined by a preliminary experiment based on a auditory masking effect of ambient noise.

Hereinafter, the preliminary experiment for calculating $Th_0$ and $Th_1$ will be briefly explained. Here, a coding method used when mode is bitrate 1 is referred to as coding method A, and a signal obtained by decoding information coded by coding method A is referred to as decoded signal A. Likewise, a coding method used when mode is bitrate 2 is referred to as coding method B, and a signal obtained by decoding information coded by coding method B is referred to as decoded signal B. Furthermore, a coding method used when mode is bitrate 3 is referred to as coding method C and a signal obtained by decoding information coded by coding method C is referred to as decoded signal C.

When average noise (e.g., white noise) is gradually added to decoded signal A and decoded signal B such that its level is gradually increased, suppose the noise level when noise-added decoded signal A becomes auditorily equal to noise-added decoded signal B is $Th_0$. Likewise, suppose noise level when noise-added decoded signal A becomes auditorily equal to noise-added decoded signal C is $Th_1$. In this way, $Th_0$ and $Th_1$ are experimentally determined using the masking effect of noise.

Next, transmission mode decision section 302 outputs the transmission mode information to transmission path 110 and signal decoding section 103.

This is the explanation of the internal configuration of transmission mode determining section 101 in FIG. 2.

Next, the configuration of signal coding section 102 in FIG. 2 will be explained using FIG. 4. Note that the configuration of signal coding section 152 in FIG. 2 is the same as that of signal coding section 102.

Here, a case will be described with this embodiment where a speech/audio signal is coded/decoded using a three-layer speech coding/decoding method made up of one base layer and two enhancement layers. However, the present invention places no restrictions on the number of layers and the present invention is also applicable to cases where a speech/audio signal is coded/decoded using a layered speech coding/decoding method having four or more layers.

The "layered speech coding method" is a method in which a plurality of speech coding methods whereby a residual signal (difference between an input signal in a lower layer and a decoded signal in a lower layer) is coded and the coded information is output exist in a higher layer, forming a layered structure. Furthermore, the "layered speech decoding method" is a method in which a plurality of speech decoding methods whereby a residual signal is decoded exist in a higher layer, forming a layered structure. Here, suppose the speech coding/decoding method which exists in the lowest layer is a base layer. Furthermore, suppose a speech coding/decoding method which exists in a higher layer than the base layer is an enhancement layer. Hereinafter, the coding section and the decoding section in the base layer are referred to as a base layer coding section and a base layer decoding section respectively and the coding section and the decoding section in an enhancement layer are referred to as an enhancement layer coding section and an enhancement layer decoding section respectively.

Signal coding section 102 is mainly constructed of transmission bit rate control section 401, control switches 402 to 405, base layer coding section 406, base layer decoding section 407, addition sections 408 and 411, first enhancement layer coding section 409, first enhancement layer decoding section 410, second enhancement layer coding section 412 and coded information integration section 413.

An input signal is input to base layer coding section 406 and control switch 402. Furthermore, transmission mode information is input to transmission bit rate control section 401.

Transmission bit rate control section 401 performs ON/OFF control of control switches 402 to 405 according to the input transmission mode information. To be more specific, when the transmission mode information is bitrate 1, transmission bit rate control section 401 sets all control switches 402 to 405 to ON. Furthermore, when the transmission mode information is bitrate 2, transmission bit rate control section 401 sets control switches 402 and 403 to ON and sets control switches 404 and 405 to OFF. Furthermore, when the transmission mode information is bitrate 3, transmission bit rate control section 401 sets all control switches 402 to 405 to OFF. In this way, transmission bit rate control section 401 performs ON/OFF control of the control switches according to the transmission mode information and a combination of coding sections used for coding of an input signal is thereby determined. Note that the transmission mode information is output from transmission bit rate control section 401 to coded information integration section 413.

Base layer coding section 406 performs coding on the input signal and outputs an information source code obtained through the coding (hereinafter referred to as "base layer information source code") to control switch 403 and coded information integration section 413. The internal configuration of base layer coding section 406 will be described later.

When control switch 403 is ON, base layer decoding section 407 decodes the base layer information source code output from base layer coding section 406 and outputs the obtained decoded signal (hereinafter referred to as "base layer decoded signal") to addition section 408. When control switch 403 is OFF, base layer decoding section 407 performs no operation. The internal configuration of base layer decoding section 407 will be described later.

When control switches 402 and 403 are ON, addition section 408 adds a signal obtained by inverting the polarity of the base layer decoded signal output from base layer decoding section 407 to the input signal and outputs a first residual signal, which is the addition result, to first enhancement layer coding section 409 and control switch 404. When control switches 402 and 403 are OFF, addition section 408 performs no operation.

When control switches 402 and 403 are ON, first enhancement layer coding section 409 performs coding on the first residual signal output from addition section 408 and outputs the information source code obtained through the coding (hereinafter referred to as "first enhancement layer information source code") to control switch 405 and coded information integration section 413. When control switches 402 and 403 are OFF, first enhancement layer coding section 409 performs no operation.

When control switch 405 is ON, first enhancement layer decoding section 410 decodes the first enhancement layer information source code output from first enhancement layer coding section 409 and outputs the obtained decoded signal through the decoding (hereinafter referred to as "first enhancement layer decoded signal") to addition section 411. When control switch 405 is OFF, first enhancement layer decoding section 410 performs no operation.

When control switches 404 and 405 are ON, addition section 411 adds a signal obtained by inverting the polarity of the output signal of first enhancement layer decoding section 410 to the first residual signal and outputs a second residual signal, which is the addition result, to second enhancement layer coding section 412. When control switches 404 and 405 are OFF, addition section 411 performs no operation.

When control switches 404 and 405 are ON, second enhancement layer coding section 412 performs coding on the second residual signal output from addition section 411 and outputs the information source code obtained through the coding (hereinafter referred to as "second enhancement layer information source code") to coded information integration section 413. When control switches 404 and 405 are OFF, second enhancement layer coding section 412 performs no operation.

Coded information integration section 413 integrates the transmission mode information output from transmission bit rate control section 401, base layer information source code output from base layer coding section 406, first enhancement layer information source code output from first enhancement layer coding section 409 and second enhancement layer information source code output from second enhancement layer coding section 412, and outputs the integrated coded information to transmission path 110.

Figure 4:
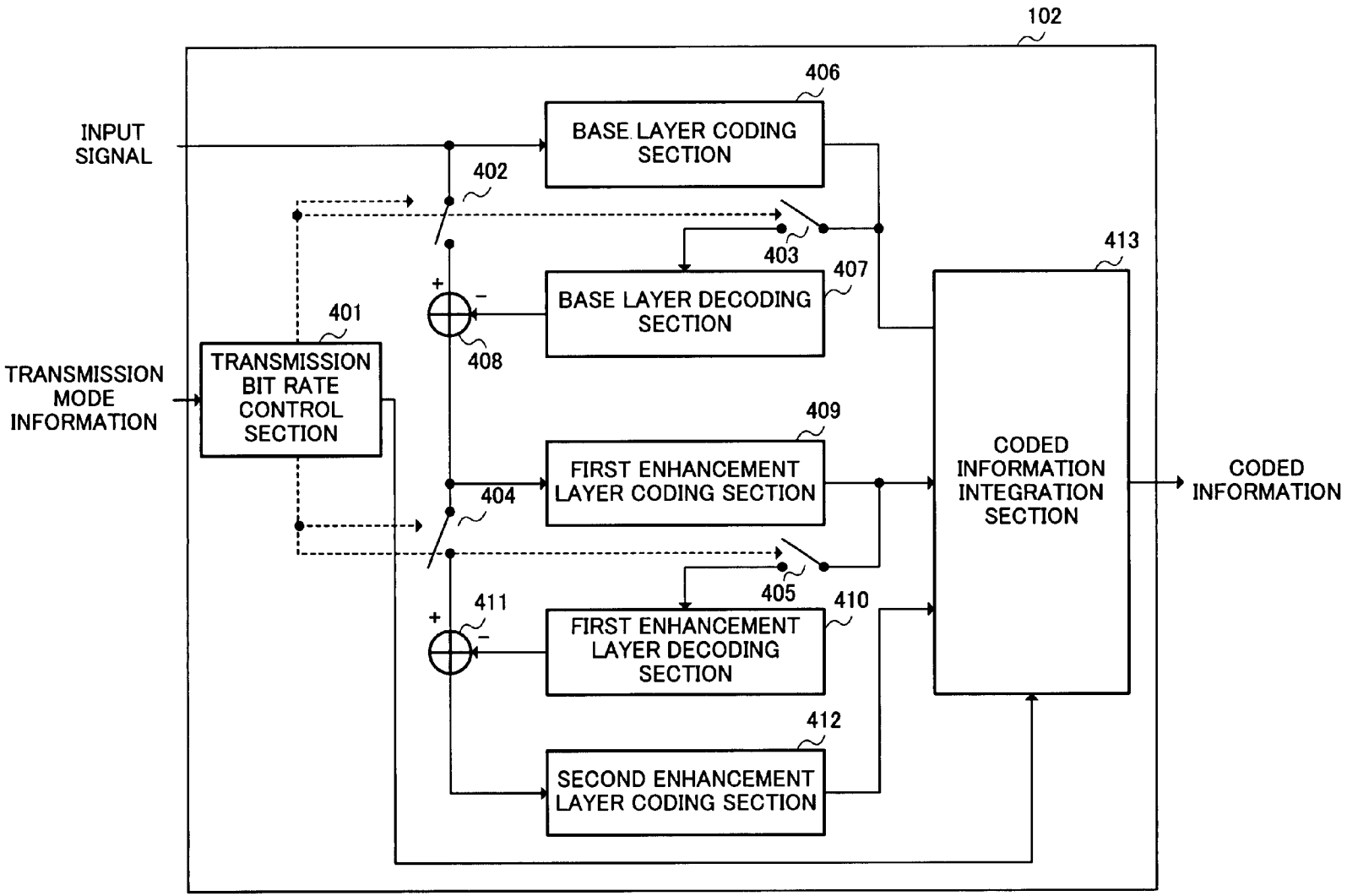
FIG. 4 is a block diagram showing the internal configuration of the signal coding section of the communication terminal apparatus according to the above described embodiment.

This is the explanation of the configuration of signal coding section 102 using FIG. 4. So far, signal coding section 102 has been explained under the condition that the transmission mode information is always input to transmission bit rate control section 401 during processing of each frame, but, when the transmission mode information is not input to transmission bit rate control section 401, it is also possible to use transmission mode information of previous input by, for example, storing the previously input transmission mode information in the buffer in transmission bit rate control section 401.

Figure 5:
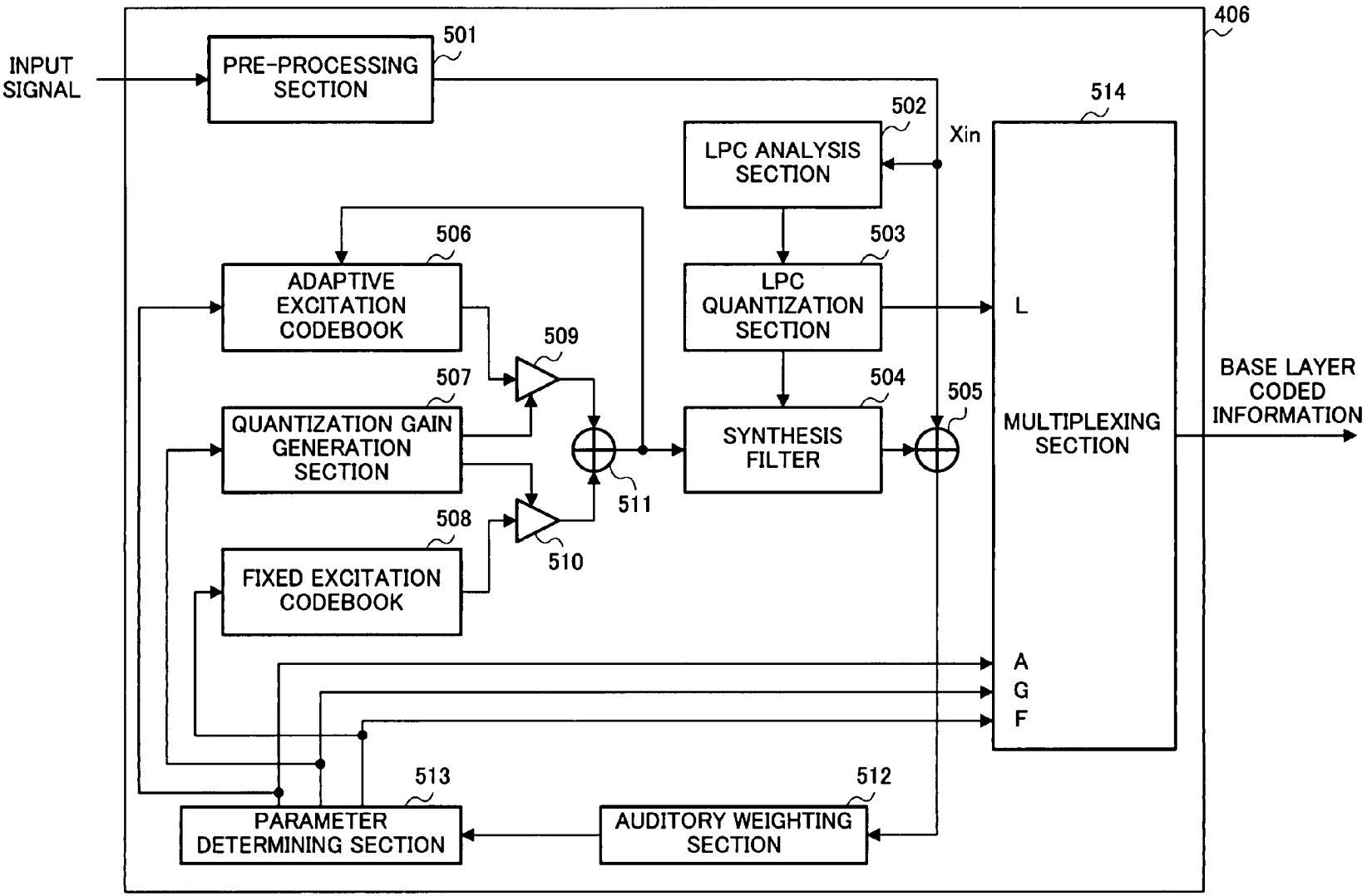
FIG. 5 is a block diagram showing the internal configuration of the base layer coding section of the communication terminal apparatus according to the above described embodiment.

Next, the configuration of base layer coding section 406 in FIG. 4 will be explained using FIG. 5. This embodiment will explain a case where base layer coding section 406 performs CELP type speech coding.

Pre-processing section 501 performs high pass filter processing for removing a DC component, wave shaping processing which will lead to performance improvement of subsequent coding processing and pre-emphasis processing on a signal of an input sampling frequency and outputs a signal (Xin) after these processing to LPC analysis section 502 and addition section 505.

LPC analysis section 502 performs a linear predictive analysis using Xin and outputs the analysis result (linear predictive coefficient) to LPC quantization section 503. LPC quantization section 503 performs quantization processing on the linear predictive coefficient (LPC) output from LPC analysis section 502 and outputs the quantization LPC to synthesis filter 504 and outputs a code (L) indicating the quantization LPC to multiplexing section 514.

Synthesis filter 504 performs filter synthesis on an excitation vector output from addition section 511 which will be described later using a filter coefficient based on the quantization LPC, thereby generating a composite signal and outputting the composite signal to addition section 505.

Addition section 505 adds a signal obtained by inverting the polarity of the composite signal to Xin, thereby calculating an error signal and outputting the error signal to auditory weighting section 512.

Adaptive excitation codebook 506 stores excitation vectors output in the past from addition section 511 in a buffer, extracts samples corresponding to 1 frame from a past excitation vector identified by a signal output from parameter determining section 513 as an adaptive excitation vector and outputs it to multiplication section 509.

Quantization gain generation section 507 outputs a quantization adaptive excitation gain and quantization fixed excitation gain identified by the signal output from parameter determining section 513 to multiplication section 509 and multiplication section 510 respectively.

Fixed excitation codebook 508 outputs a fixed excitation vector obtained by multiplying a pulse excitation vector having a shape identified by the signal output from parameter determining section 513 by a spreading vector to multiplication section 510.

Multiplication section 509 multiplies the adaptive excitation vector output from adaptive excitation codebook 506 by the quantization adaptive excitation gain output from quantization gain generation section 507 and outputs the multiplication result to addition section 511. Multiplication section 510 multiplies the fixed excitation vector output from fixed excitation codebook 508 by the quantization fixed excitation gain output from quantization gain generation section 507 and outputs the multiplication result to addition section 511.

Addition section 511 is fed the gain-multiplied adaptive excitation vector and fixed excitation vector from multiplication section 509 and multiplication section 510 respectively, adds up these vectors and outputs an excitation vector which is the addition result to synthesis filter 504 and adaptive excitation codebook 506. The excitation vector input to adaptive excitation codebook 506 is stored in a buffer.

Auditory weighting section 512 performs auditory weighting on the error signal output from addition section 505 and outputs the auditory weighting result as coding distortion to parameter determining section 513.

Parameter determining section 513 selects an adaptive excitation vector, fixed excitation vector and quantization gain that minimize coding distortion output from auditory weighting section 512 from adaptive excitation codebook 506, fixed excitation codebook 508 and quantization gain generation section 507 respectively and outputs adaptive excitation vector code (A), fixed excitation vector code (F) and excitation gain code (G) indicating the selection result to multiplexing section 514.

Multiplexing section 514 is fed code (L) indicating the quantization LPC from LPC quantization section 503, is fed code (A) indicating the adaptive excitation vector, code (F) indicating the fixed excitation vector and code (G) indicating the excitation gain from parameter determining section 513 and multiplexes these information and outputs the multiplexing result as a base layer information source code.

This is the explanation of the internal configuration of base layer coding section 406 in FIG. 4.

The internal configurations of first enhancement layer coding section 409 and second enhancement layer coding section 412 in FIG. 4 are the same as that of base layer coding section 406 and are different in only the type of signal input and the type of information source code output, and therefore explanations thereof will be omitted.

Next, the internal configuration of base layer decoding section 407 in FIG. 4 will be explained using FIG. 6. Here, a case where base layer decoding section 407 carries out CELP type speech decoding will be explained.

Figure 6:
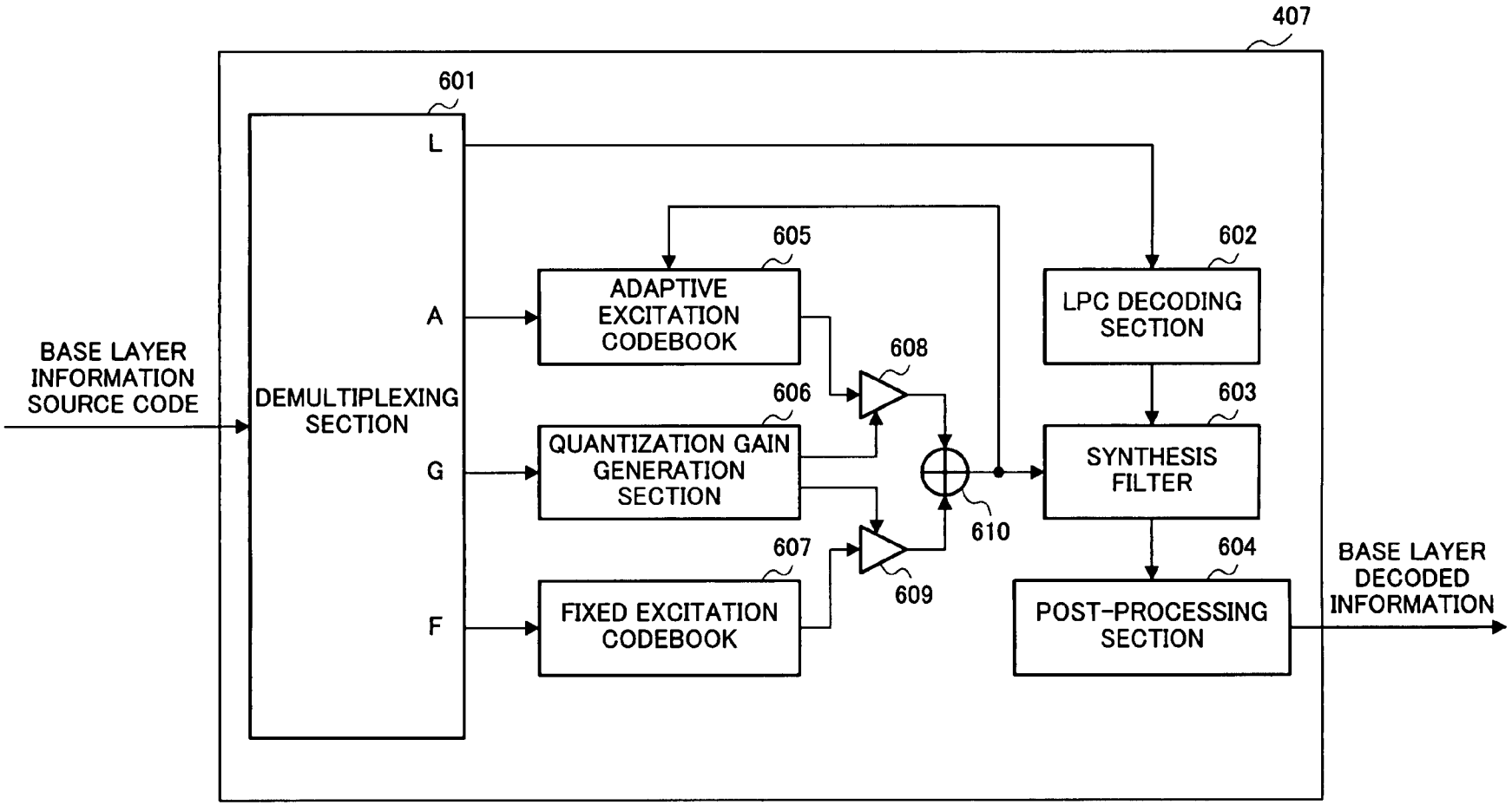
FIG. 6 is a block diagram showing the internal configuration of the base layer decoding section of the communication terminal apparatus according to the above described embodiment.

In FIG. 6, a base layer information source code input to base layer decoding section 407 is separated by demultiplexing section 601 into individual codes (L, A, G, F). The separated LPC code (L) is output to LPC decoding section 602, the separated adaptive excitation vector code (A) is output to adaptive excitation codebook 605, the separated excitation gain code (G) is output to quantization gain generation section 606 and the separated fixed excitation vector code (F) is output to fixed excitation codebook 607.

LPC decoding section 602 decodes quantization LPC from the code (L) output from demultiplexing section 601 and outputs it to synthesis filter 603.

Adaptive excitation codebook 605 extracts samples corresponding to 1 frame from a past excitation vector specified by the code (A) output from demultiplexing section 601 as an adaptive excitation vector and outputs it to multiplication section 608.

Quantization gain generation section 606 decodes the quantization adaptive excitation gain and quantization fixed excitation gain specified by the excitation gain code (G) output from demultiplexing section 601 and outputs the decoding results to multiplication section 608 and multiplication section 609.

Fixed excitation codebook 607 generates a fixed excitation vector specified by the code (F) output from demultiplexing section 601 and outputs the fixed excitation vector to multiplication section 609.

Multiplication section 608 multiplies the adaptive excitation vector by the quantization adaptive excitation gain and outputs the multiplication result to addition section 610. Multiplication section 609 multiplies the fixed excitation vector by the quantization fixed excitation gain and outputs the multiplication result to addition section 610.

Addition section 610 adds up the gain-multiplied adaptive excitation vector and fixed excitation vector output from multiplication sections 608, 609, generates an excitation vector and outputs it to synthesis filter 603 and adaptive excitation codebook 605.

Synthesis filter 603 performs filter synthesis of the excitation vector output from addition section 610 using the filter coefficient decoded by LPC decoding section 602 and outputs a composite signal to post-processing section 604.

Post-processing section 604 performs processing of improving subjective quality of speech such as formant emphasis and pitch emphasis or processing of improving subjective quality of stationary noise on the signal output from synthesis filter 603 and outputs the processed signal as base layer decoded information.

This is the explanation of the internal configuration of base layer decoding section 407 in FIG. 4.

The internal configuration of first enhancement layer decoding section 410 in FIG. 4 is the same as the internal configuration of base layer decoding section 407 and is different only in the type of information source code input and the type of signal output, and therefore explanations thereof will be omitted.

Next, the configuration of signal decoding section 103 in FIG. 2 will be explained using FIG. 7. The configuration of signal decoding section 153 in FIG. 2 is the same as the configuration of signal decoding section 103.

Signal decoding section 103 is mainly constructed of transmission bit rate control section 701, base layer decoding section 702, first enhancement layer decoding section 703, second enhancement layer decoding section 704, control switches 705 and 706 and addition sections 707 and 708.

Transmission bit rate control section 701 controls ON/OFF of control switches 705 and 706 according to transmission mode information included in received coded information. To be more specific, when the transmission mode information is bitrate 1, transmission bit rate control section 701 sets both control switches 705 and 706 to ON. Furthermore, when the transmission mode information is bitrate 2, transmission bit rate control section 701 sets control switch 705 to ON and sets control switch 706 to OFF. Furthermore, when the transmission mode information is bitrate 3, transmission bit rate control section 701 sets both control switches 705 and 706 to OFF. Furthermore, transmission bit rate control section 701 separates the received coded information into the base layer information source code, first enhancement layer information source code and second enhancement layer information source code included therein, outputs the base layer information source code to base layer decoding section 702, outputs the first enhancement layer information source code to control switch 705 and outputs the second enhancement layer information source code to control switch 706.

Base layer decoding section 702 decodes the base layer information source code output from transmission bit rate control section 701, generates a base layer decoded signal and outputs it to addition section 708.

When control switch 705 is ON, first enhancement layer decoding section 703 decodes the first enhancement layer information source code output from transmission bit rate control section 701, generates a first enhancement layer decoded signal and outputs it to addition section 707. When control switch 705 is OFF, first enhancement layer decoding section 703 performs no operation.

When control switch 706 is ON, second enhancement layer decoding section 704 decodes the second enhancement layer information source code output from transmission bit rate control section 701, generates a second enhancement layer decoded signal and outputs it to addition section 707. When control switch 706 is OFF, second enhancement layer decoding section 704 performs no operation.

When control switches 705 and 706 are ON, addition section 707 adds up the second enhancement layer decoded signal output from second enhancement layer decoding section 704 and the first enhancement layer decoded signal output from first enhancement layer decoding section 703, and outputs the signal after the addition to addition section 708. Furthermore, when control switch 706 is OFF and control switch 705 is ON, addition section 707 outputs the first enhancement layer decoded signal output from first enhancement layer decoding section 703 to addition section 708. When control switches 705 and 706 are OFF, addition section 707 performs no operation.

Addition section 708 adds up the base layer decoded signal output from base layer decoding section 702 and the output signal of addition section 707 and outputs the signal after the addition as an output signal. Furthermore, when control switches 705 and 706 are OFF, addition section 708 outputs the base layer decoded signal output from base layer decoding section 702 as an output signal.

This is the explanation of the configuration of signal decoding section 103 in FIG. 2.

Figure 7:
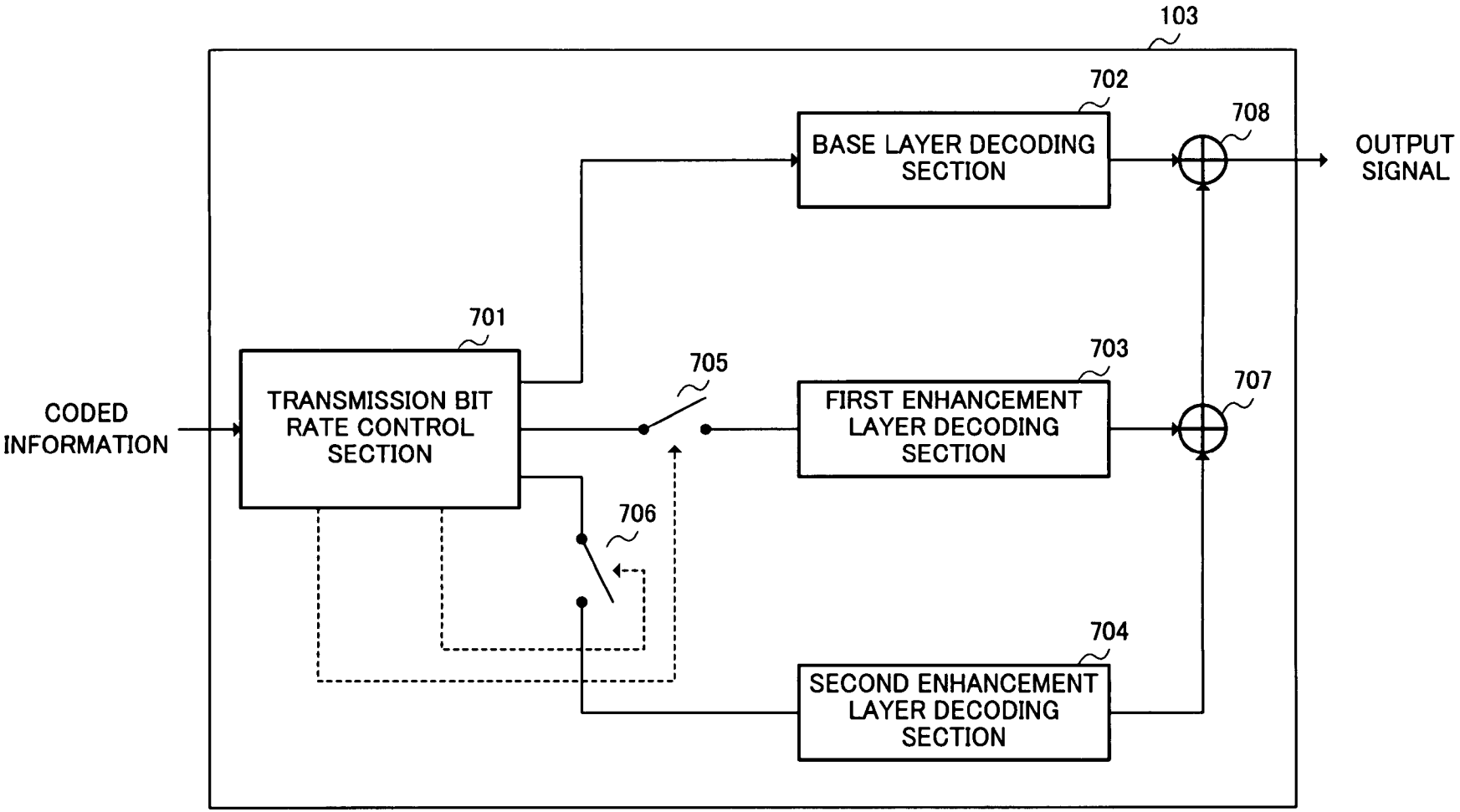
FIG. 7 is a block diagram showing the internal configuration of the signal decoding section of the communication terminal apparatus according to the above described embodiment.

Note that the internal configurations of base layer decoding section 702, first enhancement layer decoding section 703 and second enhancement layer decoding section 704 in FIG. 7 are the same as the internal configuration of base layer decoding section 407 in FIG. 4 and are only different in the type of signal input and the type of information source code output, and therefore explanations thereof will be omitted.

Here, as the coding/decoding method for signal coding section 102 and signal decoding section 103, it is also possible to apply a configuration whereby coding/decoding is performed by switching between a plurality of coding/decoding methods of different bit rates. Hereinafter, the configurations of signal coding section 102 and signal decoding section 103 in this case will be explained using FIG. 8 and FIG. 9.

This embodiment will explain the case where speech/audio signals are coded/decoded using three types of speech coding/decoding methods. However, the present invention places no limit on the number of coding/decoding methods and the present invention is also applicable to cases where speech/audio signals are coded/decoded using speech coding/decoding methods of four or more different types of bit rates.

Figure 8:
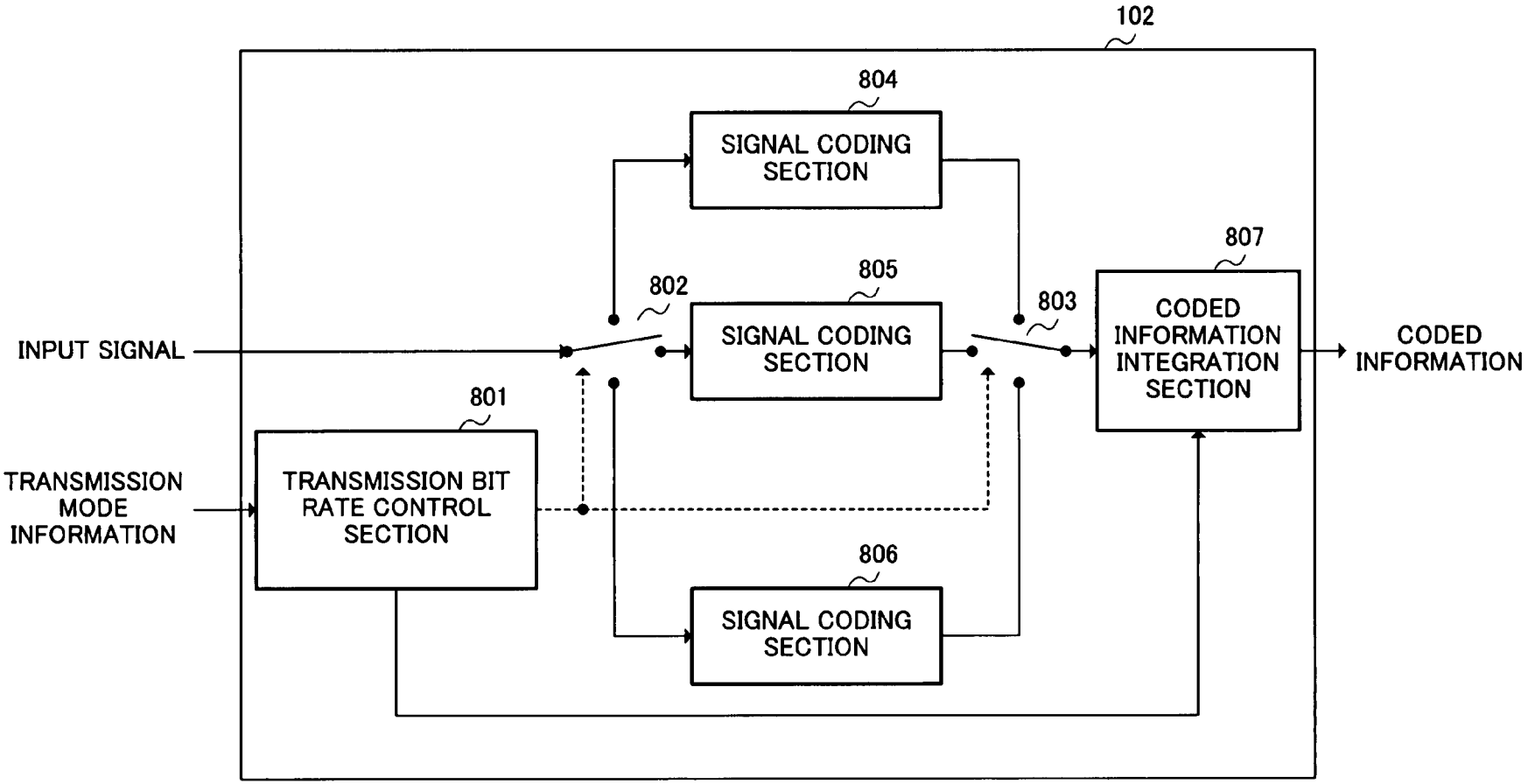
FIG. 8 is a block diagram showing the internal configuration of the signal coding section of the communication terminal apparatus according to the above described embodiment.

FIG. 8 is a block diagram showing the internal configuration of signal coding section 102. Signal coding section 102 is mainly constructed of transmission bit rate control section 801, control switches 802 and 803, signal coding sections 804 to 806 and coded information integration section 807.

An input signal is input to control switch 802. Furthermore, transmission mode information is input to transmission bit rate control section 801.

Transmission bit rate control section 801 controls switching of control switches 802 and 803 according to the input transmission mode information. To be more specific, when the transmission mode information is bitrate 1, transmission bit rate control section 801 connects both control switches 802 and 803 to signal coding section 804. Furthermore, when the transmission mode information is bitrate 2, transmission bit rate control section 801 connects both control switches 802 and 803 to signal coding section 805. Furthermore, when the transmission mode information is bitrate 3, transmission bit rate control section 801 connects both control switches 802 and 803 to signal coding section 806. Thus, transmission bit rate control section 801 controls switching of the control switches according to the transmission mode information to thereby determine a coding section to be used for coding of the input signal. The transmission mode information is output from transmission bit rate control section 801 to coded information integration section 807.

Signal coding section 804 performs coding on the input signal using a coding method corresponding to bitrate 1 and outputs the information source code obtained through coding to coded information integration section 807 through control switch 803.

Signal coding section 805 performs coding on the input signal using a coding method corresponding to bitrate 2 and outputs the information source code obtained through coding to coded information integration section 807 through control switch 803.

Signal coding section 806 performs coding on the input signal using a coding method corresponding to bitrate 3 and outputs the information source code obtained through coding to coded information integration section 807 through control switch 803.

Coded information integration section 807 integrates the transmission mode information output from transmission bit rate information control section 801 and the information source code output from switch 803 and outputs the integrated coded information to transmission path 110.

This is the explanation of the configuration of signal coding section 102 using FIG. 8. The above described case has been explained under the condition that transmission mode information is always input to transmission bit rate control section 801 every time a frame is processed, but, when the transmission mode information is not input to transmission bit rate control section 801, it is also possible to use previously input transmission mode information by, for example, storing the previously input transmission mode information in a buffer of transmission bit rate control section 801.

The internal configurations of signal coding sections 804 to 806 in FIG. 8 are the same as that of base layer coding section 406 in FIG. 4 and are only different in the type of signals input and the type of information source code output, and therefore explanations thereof will be omitted.

Figure 9:
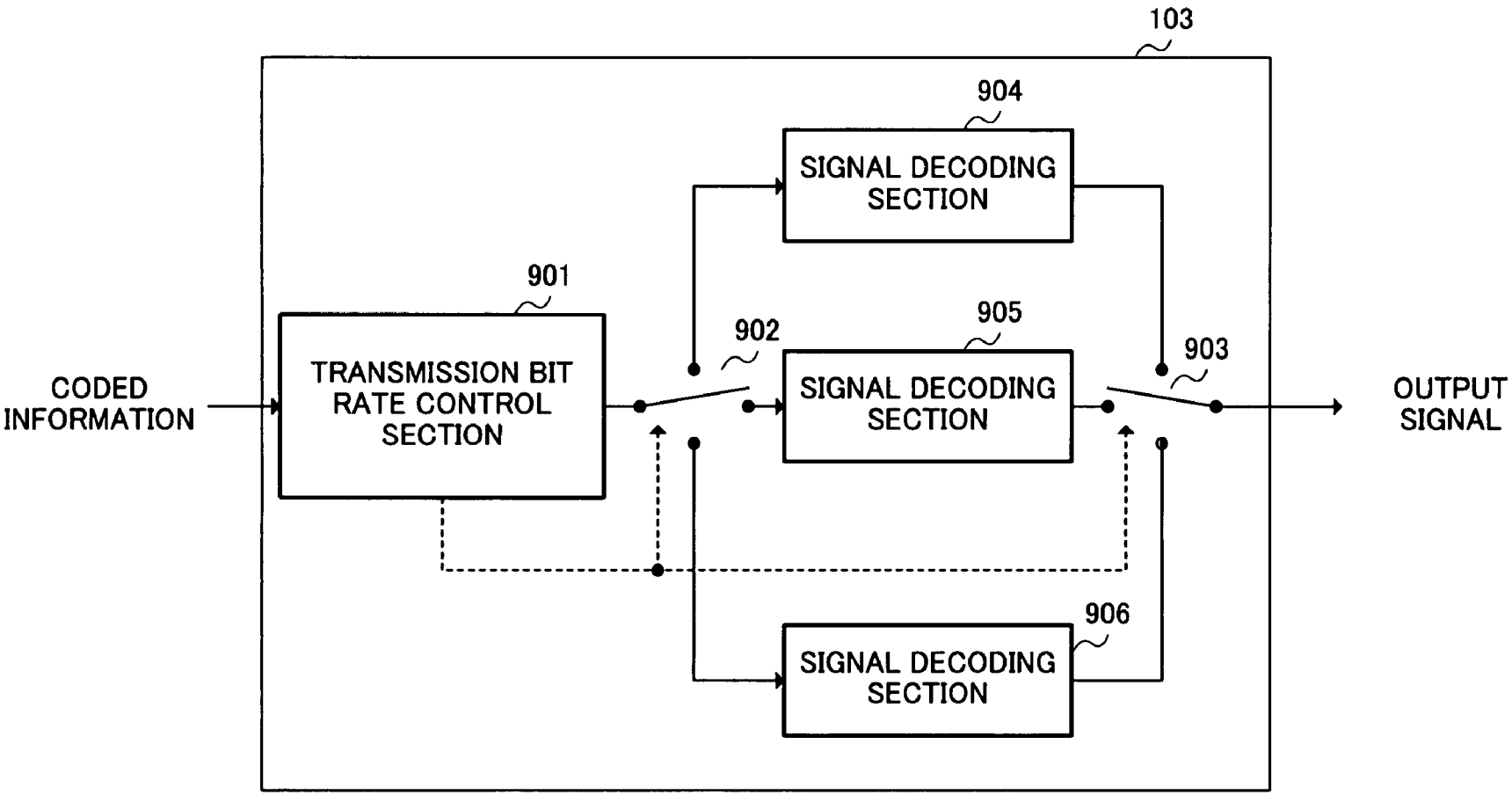
FIG. 9 is another block diagram showing the internal configuration of the signal decoding section of the communication terminal apparatus according to the above described embodiment.

FIG. 9 is a block diagram showing the internal configuration of signal decoding section 103. Signal decoding section 103 is mainly constructed of transmission bit rate control section 901, control switches 902 and 903 and signal decoding sections 904 to 906.

Coded information is input to transmission bit rate control section 901.

Transmission bit rate control section 901 controls switching of control switches 902 and 903 according to transmission mode information included in received coded information. To be more specific, when the transmission mode information is bitrate 1, transmission bit rate control section 901 connects both control switches 902 and 903 to signal decoding section 904. Furthermore, when the transmission mode information is bitrate 2, transmission bit rate control section 901 connects both control switches 902 and 903 to signal decoding section 905. Furthermore, when the transmission mode information is bitrate 3, transmission bit rate control section 901 connects both control switches 902 and 903 to signal decoding section 906. Transmission bit rate control section 901 also outputs a received information source code to control switch 902.

Signal decoding section 904 decodes the information source code input through control switch 902 using a decoding method corresponding to bitrate 1 and outputs the output signal obtained through the decoding through control switch 903.

Signal decoding section 905 decodes the information source code input through control switch 902 using a decoding method corresponding to bitrate 2 and outputs the output signal obtained through the decoding through control switch 903.

Signal decoding section 906 decodes the information source code input through control switch 902 using a decoding method corresponding to bitrate 3 and outputs the output signal obtained through the decoding through control switch 903.

This is the explanation of the configuration of signal decoding section 103 using FIG. 9.

The internal configurations of signal decoding sections 904 to 906 in FIG. 9 are the same as the internal configuration of base layer decoding section 407 in FIG. 4 and are only different in the type of information source code input and the type of signal output and explanations thereof will be omitted.

Thus, it is possible to perform efficient coding of speech/audio signals by controlling a transmission bit rate on the transmitting side according to the masking level of ambient noise with the masking effect of ambient noise on the receiving side taken into consideration.

EMBODIMENT 2

Here, the above described speech coding method such as CELP uses a speech excitation/vocal tract model, and can thereby perform efficient coding about human speech, but cannot perform efficient coding about components other than human speech such as ambient noise existing in the background. Therefore, when ambient noise exists on the transmitting side, in order to perform coding on speech/audio signals including ambient noise on the transmitting side with equal quality to the case where no ambient noise exists, more bits are required than when no ambient noise exists on the transmitting side.

Embodiment 2 will explain a case where a transmission bit rate is controlled with not only ambient noise on the receiving side but also ambient noise on the transmitting side taken into consideration.

Figure 10:
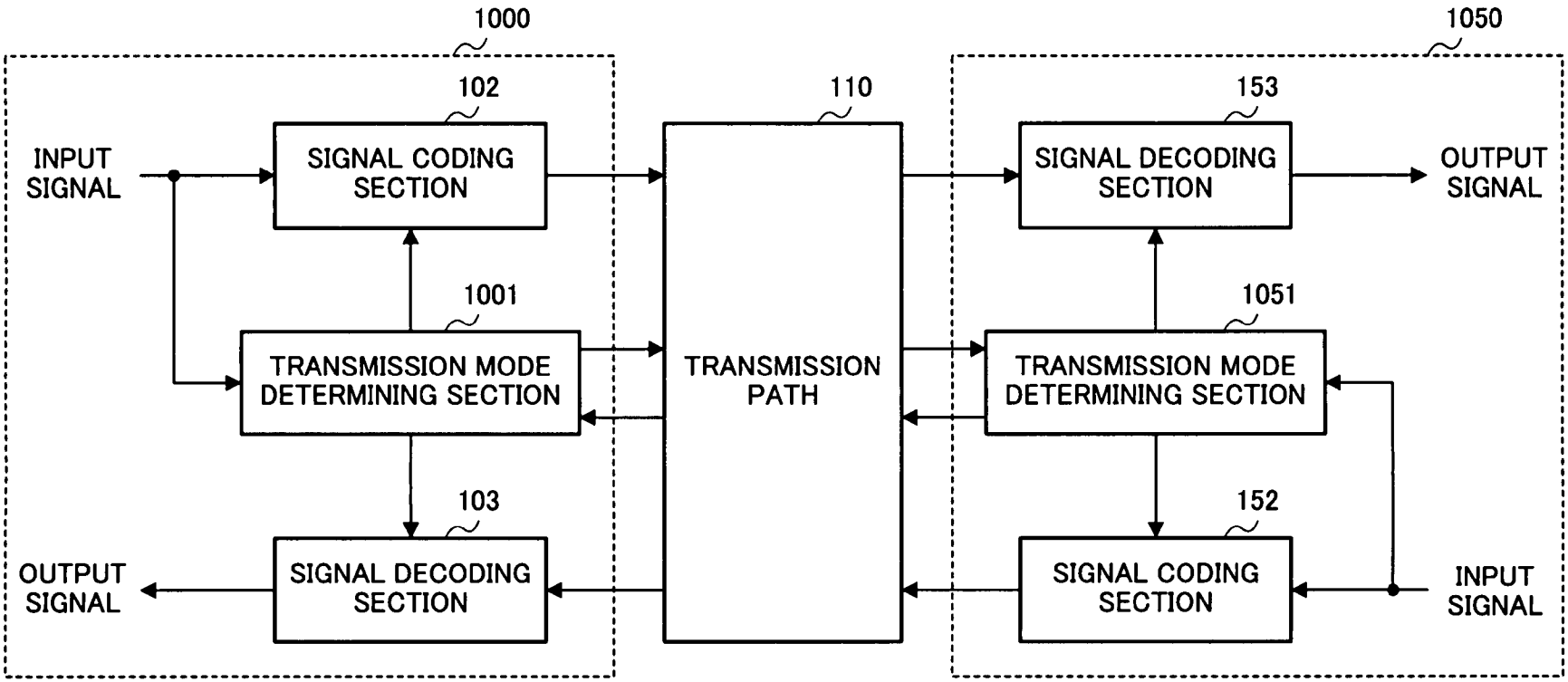
FIG. 10 is a block diagram showing the configuration of a communication terminal apparatus according to Embodiment 2 of the present invention.

FIG. 10 is a block diagram showing the configuration of a communication terminal apparatus according to Embodiment 2 of the present invention. In communication terminal apparatuses 1000 and 1050 shown in FIG. 10, components common to those of communication terminal apparatuses 100 and 150 shown in FIG. 2 are assigned the same reference numerals as those in FIG. 2 and explanations thereof will be omitted.

When communication terminal apparatus 1000 in FIG. 10 is compared to communication terminal apparatus 100 in FIG. 2, the operation of transmission mode determining section 1001 differs from that of transmission mode determining section 101. Furthermore, when communication terminal apparatus 1050 in FIG. 10 is compared to communication terminal apparatus 150 in FIG. 2, the operation of transmission mode determining section 1051 differs from that of transmission mode determining section 151.

Transmission mode determining section 1001 detects ambient noise included in the background of a speech/audio signal in an input signal, determines a transmission mode for controlling a transmission bit rate of a signal transmitted from communication terminal apparatus 1050, which is a communication terminal of a communicating party, according to the level of ambient noise and outputs transmission mode information indicating the determined transmission mode to transmission path 110. Furthermore, transmission mode determining section 1001 determines a transmission mode for controlling a transmission bit rate when performing coding/decoding based on the level of ambient noise in an input signal and transmission mode information transmitted from communication terminal apparatus 1050 through transmission path 110 and outputs transmission mode information indicating the determined transmission mode to signal coding section 102 and signal decoding section 103.

Figure 11:
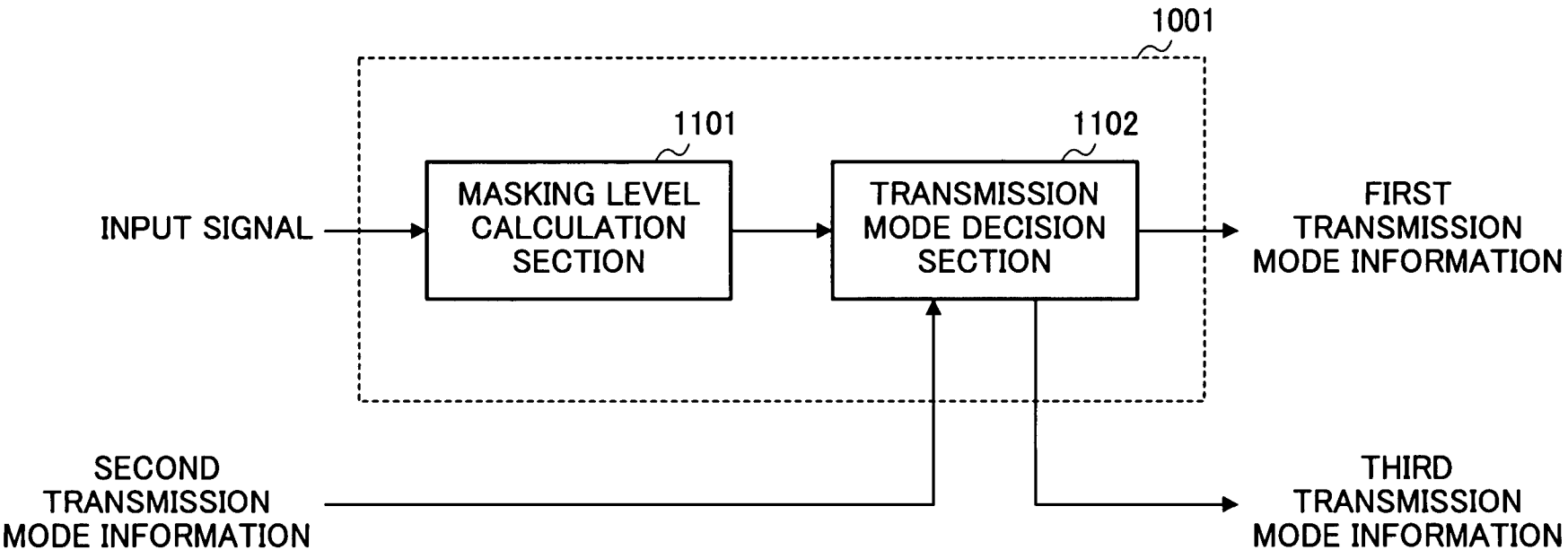
FIG. 11 is a block diagram showing the internal configuration of the transmission mode determining section of the communication terminal apparatus according to the above described embodiment.

Next, the internal configuration of transmission mode determining section 1001 in FIG. 10 will be explained using FIG. 11. Transmission mode determining section 1001 is mainly constructed of masking level calculation section 1101 and transmission mode decision section 1102. Here, a case where processing of deciding and outputting the level of ambient noise every time each frame is processed is performed will be explained. In addition to this, it is also possible to carry out subsequent processing with pressing of a button by the user of a communication terminal or the like as a trigger or carry out subsequent processing at predetermined time intervals.

As in the case of masking level calculation section 301 in FIG. 3, masking level calculation section 1101 calculates a masking level from an input signal and outputs the calculated masking level to transmission mode decision section 1102.

Transmission mode decision section 1102 determines a transmission mode for controlling a transmission bit rate with ambient noise on the transmitting side taken into consideration based on the result of a comparison between the masking level output from masking level calculation section 1101 and a predetermined threshold and outputs information indicating the determined transmission mode (hereinafter referred to as "first transmission mode information") to transmission path 110. Furthermore, transmission mode decision section 1102 determines a transmission mode for controlling a transmission bit rate with ambient noise on the transmitting side and the receiving side taken into consideration based on the first transmission mode information and transmission mode information transmitted from communication terminal apparatus 1050 through transmission path 110 (hereinafter referred to as "second transmission mode information") and outputs information indicating the determined transmission mode (hereinafter referred to as "third transmission mode information") to signal coding section 102 and signal decoding section 103.

Here, the processing of transmission mode decision section 1102 in the case of adopting a method whereby transmission mode determining section 1001 calculates a maximum value and a minimum value of the power value of an input signal for a predetermined period, decides the level of ambient noise included in an input signal from the maximum value and minimum value and controls the bit rate according to the level will be explained.

First, transmission mode decision section 1102 determines first transmission mode information $Mode'_1$ from $Pframe_{MIN}$, $Pframe_{MAX}$ output from masking level calculation section 1101 according to Equation 4 below:

[Equation 4]

$$Mode'_1 = \begin{cases} bitrate_{high} & (Th'_0 \le Pframe'_{MAX} / Pframe'_{MIN}) \\ bitrate_{low} & (Pframe'_{MAX} / Pframe'_{MIN} < Th'_0) \end{cases} \quad (4)$$

where $Th'_0$ is a constant predetermined based on an auditory masking effect of ambient noise through an experiment similar to the preliminary experiment explained in Embodiment 1.

Next, transmission mode decision section 1102 outputs first transmission mode information $Mode'_1$ to transmission path 110.

Furthermore, transmission mode decision section 1102 calculates third transmission mode information $Mode'_3$ using second transmission mode information $Mode'_2$ transmitted from communication terminal apparatus 1050 through transmission path 110 from Equation 5 below and outputs it to signal coding section 102 and signal decoding section 103.

[Equation 5]

$$Mode'_3 = \begin{cases} bitrate_1 & \begin{cases} (Mode'_1 = bitrate_{low}) \text{and} (Mode'_2 = bitrate_{high}) \\ ((Mode'_1 = bitrate_{high}) \text{and} (Mode'_2 = bitrate_{high})) \end{cases} \\ bitrate_2 & \text{or} \\ bitrate_3 & \begin{cases} ((Mode'_1 = bitrate_{low}) \text{and} (Mode'_2 = bitrate_{low})) \\ ((Mode'_1 = bitrate_{high}) \text{and} (Mode'_2 = bitrate_{low})) \end{cases} \end{cases} \quad (5)$$

This is the explanation of the internal configuration of transmission mode determining section 1001 in FIG. 10.

The configuration of transmission mode determining section 1051 in FIG. 10 is the same as the configuration of transmission mode determining section 1001 in FIG. 10.

In this way, when there are sounds of running cars or trains or the like on the receiving side, the receiving side recognizes such ambient noise and uses a masking effect of ambient noise and the transmitting side can thereby communicate a speech/audio signal using a minimum transmission bit rate within a range that does not influence human auditory sense and thereby substantially improve the channel efficiency. Furthermore, by detecting not only ambient noise on the receiving side but also information on ambient noise on the transmitting side and using this for coding of a speech/audio signal, it is possible to realize a more efficient communication.

EMBODIMENT 3

Embodiment 3 will explain an example where a transmission mode information determining method of the present invention is applied to one-way communication typified by music delivery service using portable terminals such as cellular phones.

Figure 12:
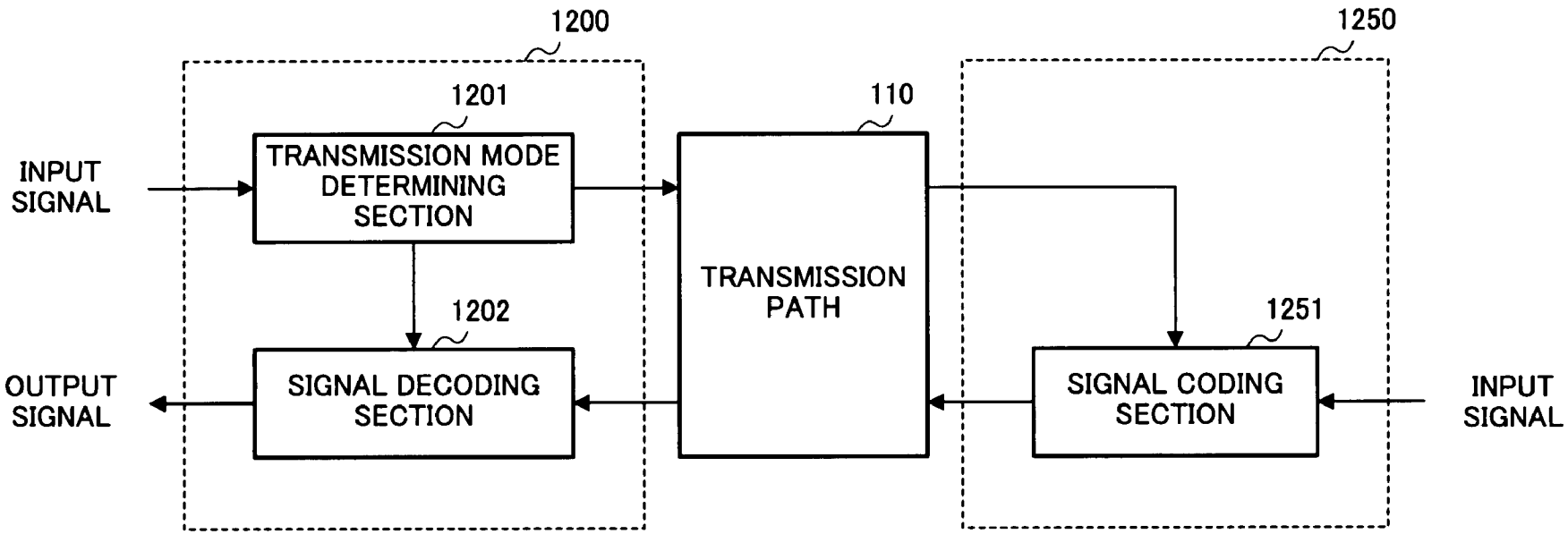
FIG. 12 is a block diagram showing the configuration of a communication apparatus according to Embodiment 3 of the present invention.

FIG. 12 is a block diagram showing the configuration of a communication apparatus according to Embodiment 3. In FIG. 12, communication apparatus 1200 is a communication terminal apparatus on the user side that receives a music delivery service and communication apparatus 1250 is a base station apparatus on the music delivery server side.

Communication apparatus 1200 is mainly constructed of transmission mode determining section 1201 and signal decoding section 1202. Communication apparatus 1250 is provided with signal coding section 1251.

Transmission mode determining section 1201 detects ambient noise included in the background of an input signal which is a speech/audio signal, determines a transmission mode for controlling a transmission bit rate at communication apparatus 1250 according to the level of ambient noise and outputs this as transmission mode information to transmission path 110 and signal decoding section 1202.

Signal coding section 1251 performs coding on the input signal based on the transmission mode information transmitted through transmission path 110 and then integrates it with the transmission mode information and outputs this as coded information to transmission path 110.

Signal decoding section 1202 decodes coded information transmitted through transmission path 110 and outputs the obtained decoded signal as an output signal. Signal decoding section 1202 compares the transmission mode information included in the coded information output from transmission path 110 with the transmission mode information obtained from transmission mode determining section 1201 with a transmission delay taken into consideration, and can thereby detect transmission errors. To be more specific, when the transmission mode information obtained from transmission mode determining section 1201 with a transmission delay taken into consideration is different from the transmission mode information included in the coded information output from transmission path 110, signal decoding section 1202 decides that a transmission error has occurred in transmission path 110. Furthermore, it is also possible to adopt a technique whereby signal coding section 1251 of communication apparatus 1250 does not integrate the transmission mode information with the coded information, while signal decoding section 1202 decodes the coded information output from transmission path 110 using transmission mode information obtained from transmission mode determining section 1201.

The internal configurations of transmission mode determining section 1201, signal coding section 1202 and signal decoding section 1251 in FIG. 12 are the same as those of transmission mode determining section 101, signal coding section 102 and signal decoding section 103 shown in FIG. 2, and therefore detailed explanations of those configurations will be omitted.

Thus, according to this embodiment, ambient noise in a communication apparatus is detected even in a one-way communication system such as music delivery service and transmission mode information is determined using an auditory masking effect of ambient noise, and therefore base station apparatus can communicate a speech/audio signal using a minimum transmission bit rate within a range that does not influence human auditory sense, and can thereby substantially improve the channel efficiency.

EMBODIMENT 4

Embodiment 4 will explain a case where a transmission mode is determined by decoding coded information transmitted from another party and detecting ambient noise included in the obtained decoded signal.

Figure 13:
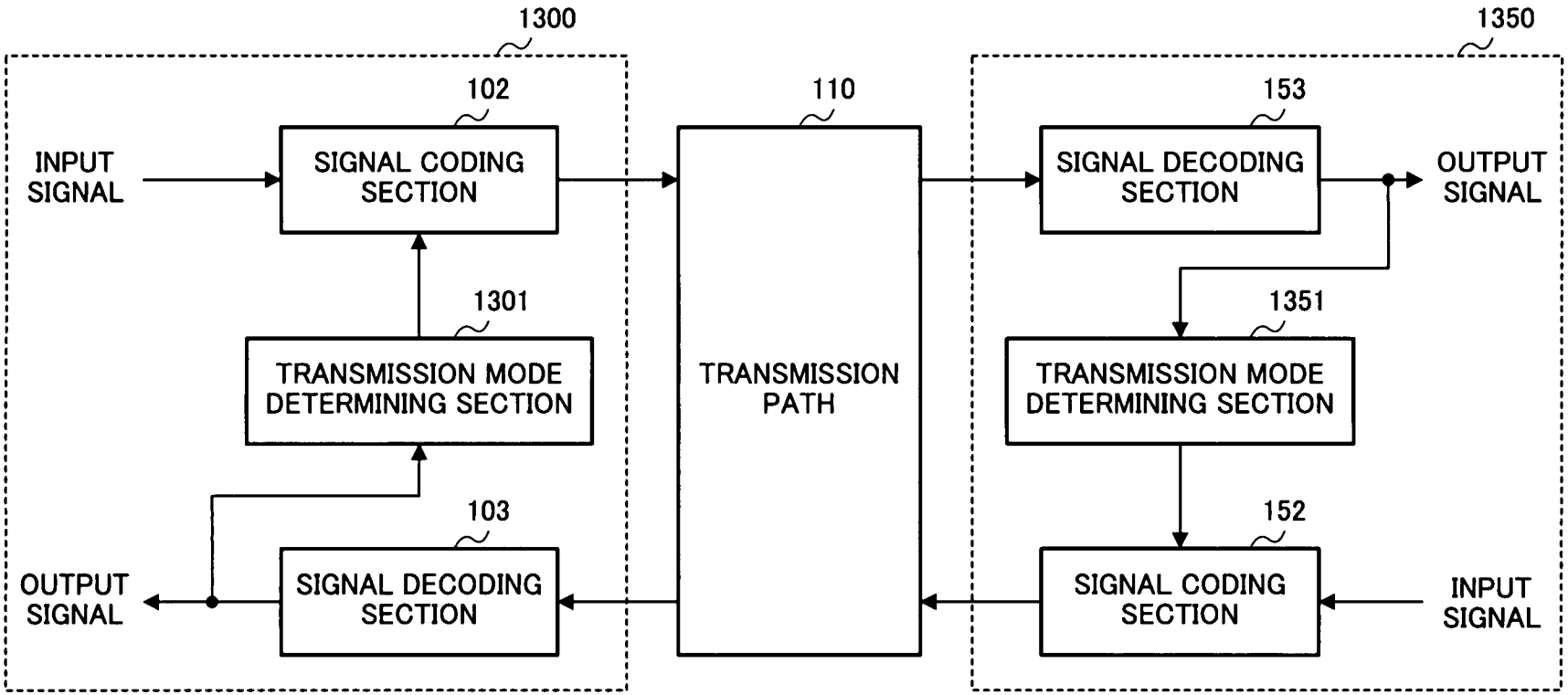
FIG. 13 is a block diagram showing the configuration of a communication terminal apparatus according to Embodiment 4 of the present invention.

FIG. 13 is a block diagram showing the configuration of a communication terminal apparatus according to Embodiment 4. In communication terminal apparatuses 1300, 1350 shown in FIG. 13, components common to communication terminal apparatuses 100 and 150 shown in FIG. 2 are assigned the same reference numerals as those in FIG. 2 and explanations thereof will be omitted.

When communication terminal apparatus 1300 in FIG. 13 is compared to communication terminal apparatus 100 in FIG. 2, the operation of transmission mode determining section 1301 is different from that of transmission mode determining section 101. Furthermore, when communication terminal apparatus 1350 in FIG. 13 is compared to communication terminal apparatus 150 in FIG. 2, the operation of transmission mode determining section 1351 is different from that of transmission mode determining section 151.

Transmission mode determining section 1301 detects ambient noise included in a decoded signal, determines a transmission mode for controlling a transmission bit rate when performing coding according to the level of ambient noise and outputs transmission mode information indicating the determined transmission mode to signal coding section 102.

Figure 14:
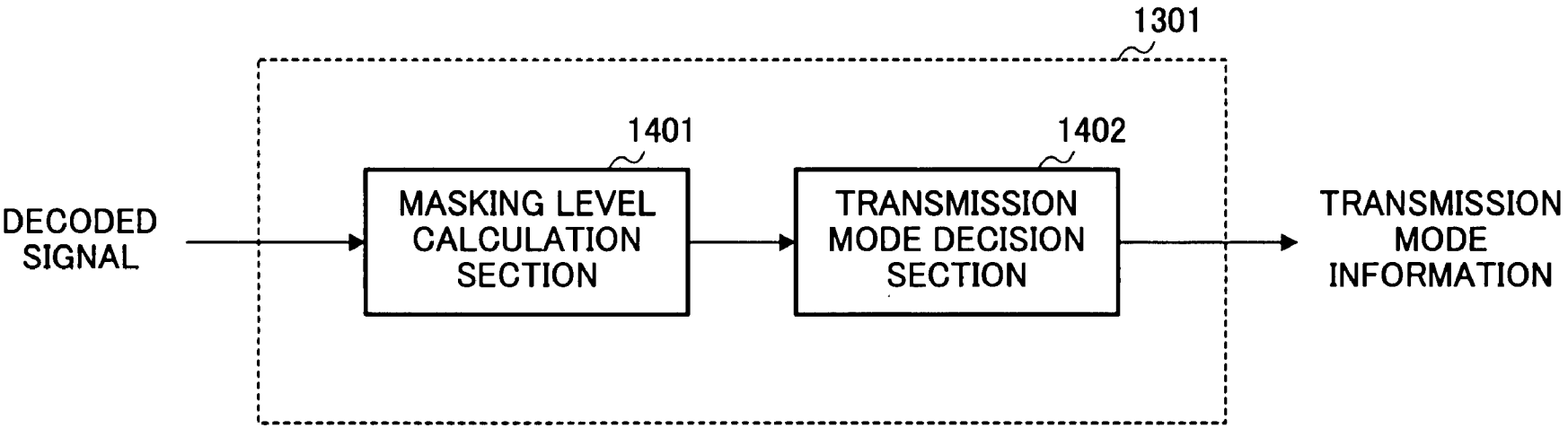
FIG. 14 is a block diagram showing the internal configuration of the transmission mode determining section of the communication terminal apparatus according to the above described embodiment.

Next, the internal configuration of transmission mode determining section 1301 in FIG. 13 will be explained using FIG. 14. Transmission mode determining section 1301 is mainly constructed of masking level calculation section 1401 and transmission mode decision section 1402. As in the case of transmission mode determining section 101 in FIG. 2, in addition to a technique of carrying out processing of deciding and outputting the level of ambient noise every time each frame is processed, transmission mode determining section 1301 in FIG. 13 can also perform subsequent processing with pressing of a button by the user of a communication terminal as a trigger or perform subsequent processing at certain time intervals.

As in the case of masking level calculation section 301 in FIG. 3, masking level calculation section 1401 calculates the masking level from the decoded signal output from signal decoding section 103 and outputs the calculated masking level to transmission mode decision section 1402.

As in the case of transmission mode decision section 302 in FIG. 3, transmission mode decision section 1402 compares the masking level output from masking level calculation section 1401 with a predetermined threshold, determines a transmission mode for controlling a transmission bit rate based on the comparison result and outputs transmission mode information indicating the determined transmission mode to signal coding section 102.

The internal configuration of transmission mode determining section 1351 in FIG. 13 is the same as the configuration of transmission mode determining section 1301, and therefore detailed explanations thereof will be omitted.

Thus, according to this embodiment, by decoding coded information transmitted from the communicating party and detecting ambient noise included in the obtained decoded signal, it is possible to use the masking effect of ambient noise thereof and perform highly efficient signal coding.

EMBODIMENT 5

Embodiment 5 will explain a case where a transmission mode is determined using not only ambient noise on the receiving side included in a decoded signal but also ambient noise on the transmitting side.

Figure 15:
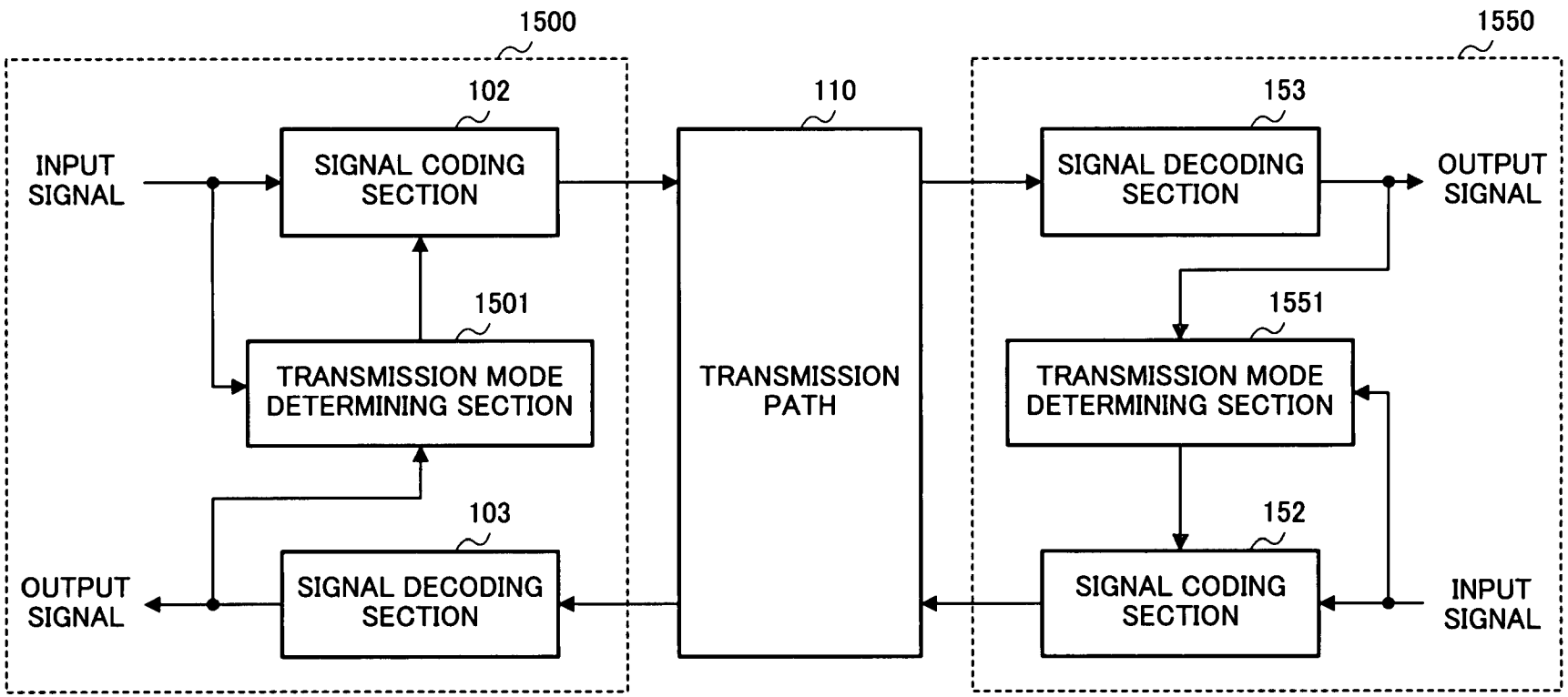
FIG. 15 is a block diagram showing the configuration of a communication terminal apparatus according to Embodiment 5 of the present invention.

FIG. 15 is a block diagram showing the configuration of a communication terminal apparatus according to Embodiment 5. In communication terminal apparatuses 1500 and 1550 shown in FIG. 15, components common to those of communication terminal apparatuses 100 and 150 shown in FIG. 2 are assigned the same reference numerals as those in FIG. 2 and explanations thereof will be omitted.

When communication terminal apparatus 1500 in FIG. 15 is compared to communication terminal apparatus 100 in FIG. 2, the operation of transmission mode determining section 1501 differs from that of transmission mode determining section 101. Furthermore, when communication terminal apparatus 1550 in FIG. 15 is compared to communication terminal apparatus 150 in FIG. 2, the operation of transmission mode determining section 1551 differs from that of transmission mode determining section 151.

Transmission mode determining section 1501 detects ambient noise included in the background of a speech/audio signal of an input signal, detects ambient noise included in the decoded signal, determines a transmission mode for controlling a transmission bit rate when performing coding according to the level of ambient noise and outputs transmission mode information indicating the determined transmission mode to signal coding section 102.

Next, the internal configuration of transmission mode determining section 1501 in FIG. 15 will be explained using FIG. 16. Transmission mode determining section 1501 is mainly constructed of masking level calculation section 1601 and transmission mode decision section 1602. As in the case of transmission mode determining section 101 in FIG. 2, transmission mode determining section 1501 in FIG. 15 can use a technique of performing not only processing of deciding and outputting the level of ambient noise every time each frame is processed but also subsequent processing with pressing of a button by the user of a communication terminal as a trigger or subsequent processing at predetermined intervals.

Masking level calculation section 1601 calculates a masking level from an input signal and a decoded signal output from signal decoding section 103 and outputs the calculated masking level to transmission mode decision section 1602.

As in the case of transmission mode decision section 302 in FIG. 3, transmission mode decision section 1602 compares the masking level output from masking level calculation section 1601 with a predetermined threshold, determines a transmission mode for controlling a transmission bit rate based on the comparison result and outputs transmission mode information indicating the determined transmission mode to signal coding section 102.

Here, the processing of masking level calculation section 1601 and transmission mode decision section 1602 will be explained when a method whereby transmission mode determining section 1501 calculates a maximum value and minimum value of the power value of the input signal for a predetermined period, decides the level of ambient noise included in the input signal from the maximum value and minimum value and controls the bit rate according to the level is adopted.

Masking level calculation section 1601 intervals the input signal into groups of N samples (N: natural number), regards each interval as 1 frame and performs processing in frame units. Hereinafter, the input signal to be coded will be expressed as $u'_n$ (n=0, . . . , N−1).

Furthermore, masking level calculation section 1601 includes buffers $bufu'_i$ (i=0, . . . , $N_i$−1).

Next, masking level calculation section 1601 will calculate frame power Pframeu' of the frame to be processed from Equation 6 below:

[Equation 6]

$$Pframe' = \sum_{n=0}^{N-1} |u'_n|^2 \tag{6}$$

Next, masking level calculation section 1601 substitutes frame power Pframeu' calculated from Equation 6 into buffer $bufu'_{Ni-1}$.

Next, masking level calculation section 1601 calculates minimum value $Pframeu'_{MIN}$ and maximum value $Pframeu'_{MAX}$ of frame power Pframeu' in an i interval (interval length $N_i$) and outputs $Pframeu'_{MIN}$, $Pframeu'_{MAX}$ to transmission mode decision section 1602.

Next, masking level calculation section 1601 updates buffer $bufu'_i$ according to Equation 7 below:

[Equation 7]

$$bufu'_i = bufu'_{i+1} \ (i=0, \ldots N_i-2) \tag{7}$$

Next, masking level calculation section 1601 intervals the decoded signal output from signal decoding section 103 into groups of N samples (N: natural number), regards N samples as 1 frame and performs processing in frame units. Hereinafter, the signal to be coded will be expressed as decoded signal $u''_n$ (n=0, . . . , N−1).

Furthermore, masking level calculation section 1601 includes buffer $bufu''_i$ (i=0, . . . , $N_i$−1).

Next, masking level calculation section 1601 will calculate frame power Pframeu" to be processed from Equation 8 below:

[Equation 8]

$$Pframeu'' = \sum_{n=0}^{N-1} |u''_n|^2 \tag{8}$$

Next, masking level calculation section 1601 substitutes frame power Pframeu" calculated from Equation 8 into buffer $bufu''_{Ni-1}$.

Next, masking level calculation section 1601 calculates minimum value $Pframeu''_{MIN}$ and maximum value $Pframeu''_{MAX}$ of frame power Pframeu' in an i interval (interval length $N_i$) and outputs $Pframeu''_{MIN}$, $Pframeu''_{MAX}$ to transmission mode decision section 1602.

Next, masking level calculation section 1601 updates buffer $bufu''_i$ according to Equation 9 below:

[Equation 9]

$$bufu''_i = bufu''_{i+1} \ (i=0, \ldots N_i-2) \tag{9}$$

Figure 16:
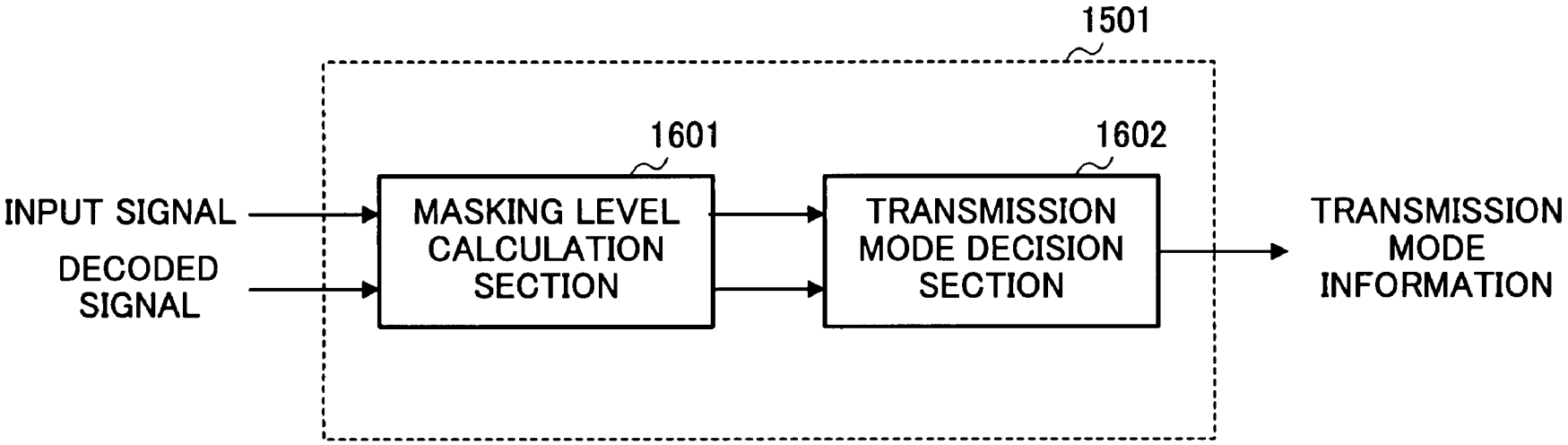
FIG. 16 is a block diagram showing the internal configuration of the transmission mode determining section of the communication terminal apparatus according to the above described embodiment.

This is the explanation of the processing by masking level calculation section 1601 in FIG. 16.

Next, the processing of transmission mode decision section 1602 will be explained. Transmission mode decision section 1602 determines transmission mode information $Modeu'_1$ from $Pframeu''_{MIN}$, $Pframeu''_{MAX}$ output from masking level calculation section 1601 according to Equation 10 below:

[Equation 10]

$$Modeu'_1 = \begin{cases} bitrate_{high} & (Thu'_0 \le Pframeu'_{MAX} / Pframeu'_{MIN}) \\ bitrate_{low} & (Pframeu'_{MAX} / Pframeu'_{MIN} < Thu'_0) \end{cases} \tag{10}$$

where $Thu'_0$ is a constant predetermined by an experiment similar to the aforementioned preliminary experiment based on a auditory masking effect of ambient noise.

Next, transmission mode decision section 1602 determines transmission mode information $Modeu'_2$ from $Pframeu''_{MIN}$, $Pframeu''_{MAX}$ output from masking level calculation section 1601 according to Equation 11 below:

[Equation 11]

$$Modeu'_2 = \begin{cases} bitrate_{high} & (Thu''_0 \le Pframeu''_{MAX} / Pframeu''_{MIN}) \\ bitrate_{low} & (Pframeu''_{MAX} / Pframeu''_{MIN} < Thu''_0) \end{cases} \tag{11}$$

where $Thu''_0$ is a constant predetermined by an experiment similar to the aforementioned preliminary experiment based on the auditory masking effect of ambient noise.

Next, transmission mode decision section 1602 calculates transmission mode information $Modeu'_3$ using transmission mode information $Modeu'_1$ and transmission mode information $Modeu'_2$ according to Equation 12 below and outputs it to signal coding section 102.

[Equation 12]

[Equation 12]

$$Modeu'_3 = \begin{cases} bitrate_1 \\ bitrate_2 \begin{cases} (Modeu'_1 = bitrate_{low}) \text{and} (Modeu'_2 = bitrate_{high}) \\ ((Modeu'_1 = bitrate_{high}) \text{and} (Modeu'_2 = bitrate_{high})) \\ \text{or} \\ ((Modeu'_1 = bitrate_{low}) \text{and} (Modeu'_2 = bitrate_{low})) \\ (Modeu'_1 = bitrate_{high}) \text{and} (Modeu'_2 = bitrate_{low}) \end{cases} \\ bitrate_3 \end{cases} \quad (12)$$

This is the explanation of the internal configuration of transmission mode determining section 1501 in FIG. 15.

The internal configuration of transmission mode determining section 1551 in FIG. 15 is the same as that of transmission mode determining section 1501, and therefore explanations thereof will be omitted.

Thus, according to this embodiment, when there are sounds of running cars and trains on the receiving side, the transmitting side recognizes ambient noise included in a speech/audio signal transmitted from the receiving side, uses a masking effect of ambient noise and the transmitting side can thereby carry out communication using a minimum transmission bit rate within a range that does not influence human auditory sense and thereby substantially improve the channel efficiency. Furthermore, by detecting not only ambient noise on the receiving side but also information on ambient noise on the transmitting side and using it for speech/audio signal coding, it is possible to realize a more efficient communication.

EMBODIMENT 6

Embodiment 6 will explain a case where a relay station in transmission path 110 adjusts a transmission bit rate transmitted from each communication terminal apparatus in an environment in which communication is carried out according to a scalable coding scheme.

Figure 17:
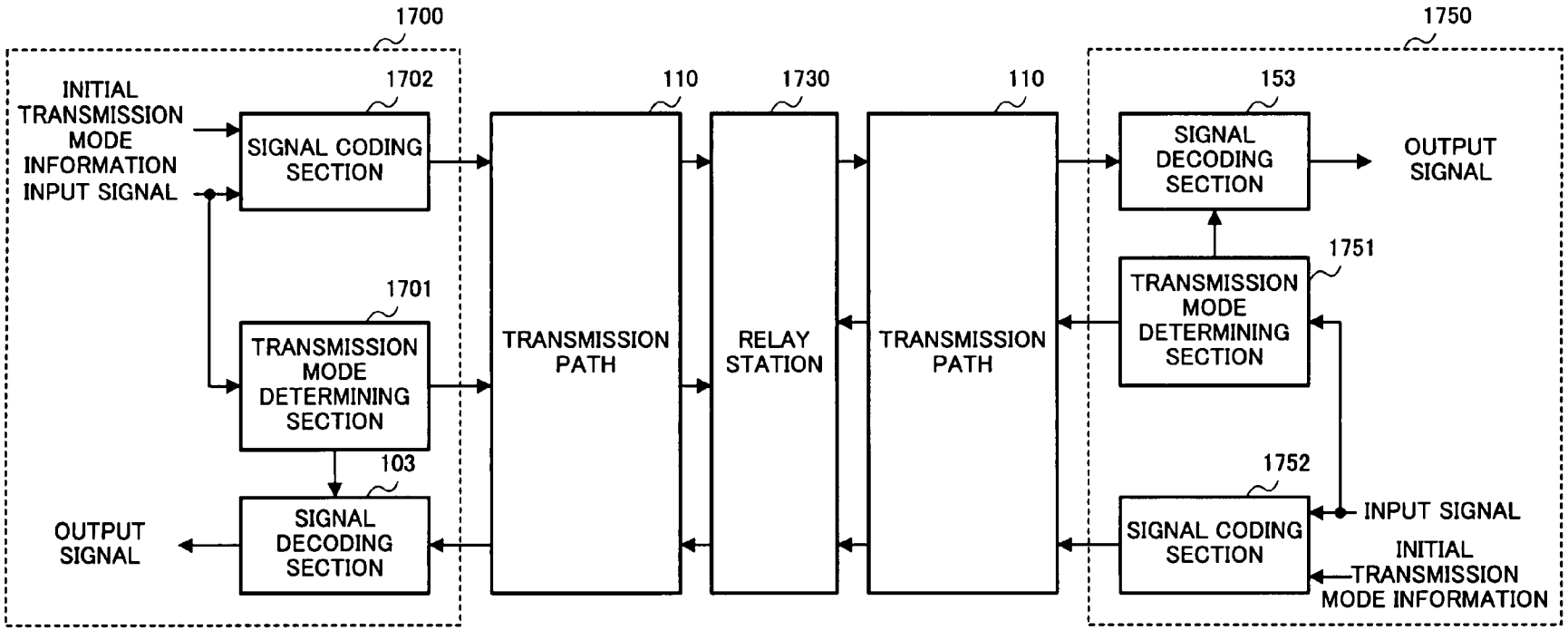
FIG. 17 is a block diagram showing the configuration of a communication terminal apparatus and relay station according to Embodiment 6 of the present invention.

FIG. 17 is a block diagram showing the configuration of a communication terminal apparatus and relay station according to Embodiment 6 of the present invention. Furthermore, relay station 1730 exists in midstream of a communication of communication terminal apparatuses 1700 and 1750 in FIG. 17. In communication terminal apparatuses 1700, 1750 shown in FIG. 17, components common to those of communication terminal apparatuses 100 and 150 shown in FIG. 2 are assigned the same reference numerals as those in FIG. 2 and explanations thereof will be omitted.

When communication terminal apparatus 1700 in FIG. 17 is compared to communication terminal apparatus 100 in FIG. 2, the operations of transmission mode determining section 1701 and signal coding section 1702 differ from those of transmission mode determining section 101 and signal coding section 102. Furthermore, when communication terminal apparatus 1750 in FIG. 17 is compared to communication terminal apparatus 150 in FIG. 2, the operations of transmission mode determining section 1751 and signal coding section 1752 differ from those of transmission mode determining section 151 and signal coding section 152.

Transmission mode determining section 1701 detects ambient noise included in the background of a speech/audio signal in an input signal, determines a transmission mode for controlling a transmission bit rate when performing coding according to the level of ambient noise and outputs transmission mode information indicating the determined transmission mode to transmission path 110 and signal decoding section 103. As in the case of transmission mode determining section 101 in FIG. 2, in addition to the technique whereby transmission mode determining section 1701 in FIG. 17 performs processing of deciding and outputting the level of ambient noise every time each frame is processed, it is also possible to perform subsequent processing with pressing of a button by the user of the communication terminal as a trigger or perform subsequent processing at predetermined intervals.

Signal coding section 1702 is fed the input signal and initial transmission mode information, performs coding on the input signal according to the initial transmission mode information and outputs the coded information obtained to transmission path 110. The internal configuration of signal coding section 1702 corresponds to signal coding section 102 shown in FIG. 4 with the transmission mode information replaced by the initial transmission mode information.

Transmission mode determining section 1751 detects ambient noise included in the background of a speech/audio signal in the input signal, determines a transmission mode for controlling a transmission bit rate when performing coding according to the level of ambient noise and outputs transmission mode information indicating the determined transmission mode to transmission path 110 and signal decoding section 153.

Signal coding section 1752 is fed the input signal and initial transmission mode information, performs coding on the input signal according to initial transmission mode information, integrates an information source code obtained with the initial transmission mode information and outputs this as coded information to transmission path 110.

Suppose initial transmission mode information mode A in communication terminal apparatuses 1700, 1750 is expressed by Equation 13 below:

[Equation 13]

$$ModeA = \begin{cases} bitrate_1 \\ bitrate_2 \\ bitrate_3 \end{cases} \quad (13)$$

The internal configuration of transmission mode determining section 1751 in FIG. 17 is the same as that of transmission mode determining section 1701, and therefore explanations thereof will be omitted.

Figure 18:
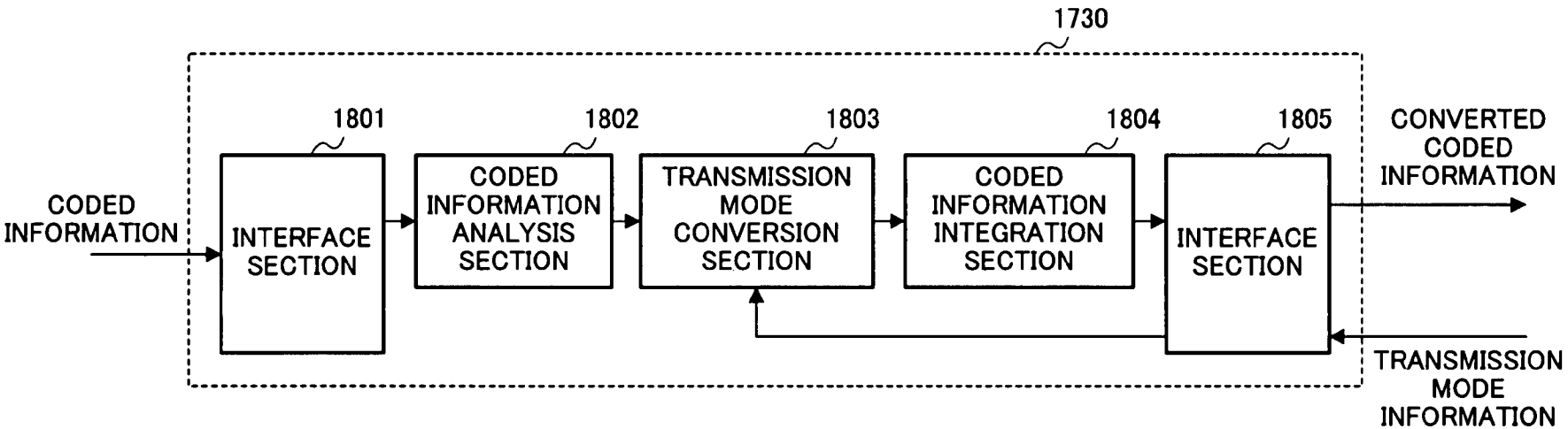
FIG. 18 is a block diagram showing the configuration of the relay station according to the above described embodiment.

Next, the internal configuration of relay station 1730 will be explained using FIG. 18. In FIG. 18, a case where the transmission bit rate of the coded information from communication terminal apparatus 1700 is controlled according to the transmission mode information from communication terminal apparatus 1750 will be explained, but the same applies to a case where the transmission bit rate of the coded information from communication terminal apparatus 1750 is controlled according to the transmission mode information from communication terminal apparatus 1700.

Relay station 1730 is mainly constructed of interface section 1801, coded information analysis section 1802, transmission mode conversion section 1803, coded information integration section 1804 and interface section 1805.

Interface section 1801 is fed information transmitted from communication terminal apparatus 1700 through transmission path 110 and transmits information to communication terminal apparatus 1750 through transmission path 110.

Coded information analysis section 1802 analyzes the information transmitted from communication terminal apparatus 1700, separates it into an information source code and initial transmission mode information mode A coded in their respective layers inside signal coding section 1702 and outputs the information to transmission mode conversion section 1803.

Transmission mode conversion section 1803 performs transmission bit rate conversion processing on the information source code and initial transmission mode information mode A according to transmission mode information mode B transmitted from communication terminal apparatus 1750. To be more specific, when initial transmission mode information mode A is bitrate 1 and transmission mode information mode B is bitrate 2, transmission mode conversion section 1803 changes initial transmission mode information mode A to bitrate 2 and outputs the base layer information source code, first enhancement layer information source code and initial transmission mode information mode A to coded information integration section 1804. Furthermore, when initial transmission mode information mode A is bitrate 1 and transmission mode information mode B is bitrate 3, transmission mode conversion section 1803 changes initial transmission mode information mode A to bitrate 3 and outputs the base layer information source code and initial transmission mode information mode A to coded information integration section 1804. Furthermore, when transmission mode information mode A is bitrate 2 and transmission mode information mode B is bitrate 3, transmission mode conversion section 1803 changes initial transmission mode information mode A to bitrate 3 and outputs the base layer information source code and initial transmission mode information mode A to coded information integration section 1804. Furthermore, for combinations of initial transmission mode information mode A and transmission mode information mode B other than those described above, transmission mode conversion section 1803 outputs the information source code and initial transmission mode information mode A to coded information integration section 1804 as they are.

Coded information integration section 1804 is fed the information source code and initial transmission mode information mode A obtained from transmission mode conversion section 1803, integrates them and outputs the integration result as converted coded information to interface section 1805.

Interface section 1805 is fed information transmitted from communication terminal apparatus 1750 through transmission path 110 and transmits information to communication terminal apparatus 1700 through transmission path 110.

This is the explanation of the configuration of relay station 1730 in FIG. 17.

Thus, according to this embodiment, when there is ambient noise such as sounds of running cars and trains on the receiving side, the relay station can also control the transmission bit rate instead of the transmitting side. This allows more flexible control of the transmission bit rate and can further improve channel efficiency.

In this embodiment, the relay station can also determine a transmission mode for controlling a transmission bit rate using not only ambient noise on the receiving side but also ambient noise on the transmitting side.

Figure 19:
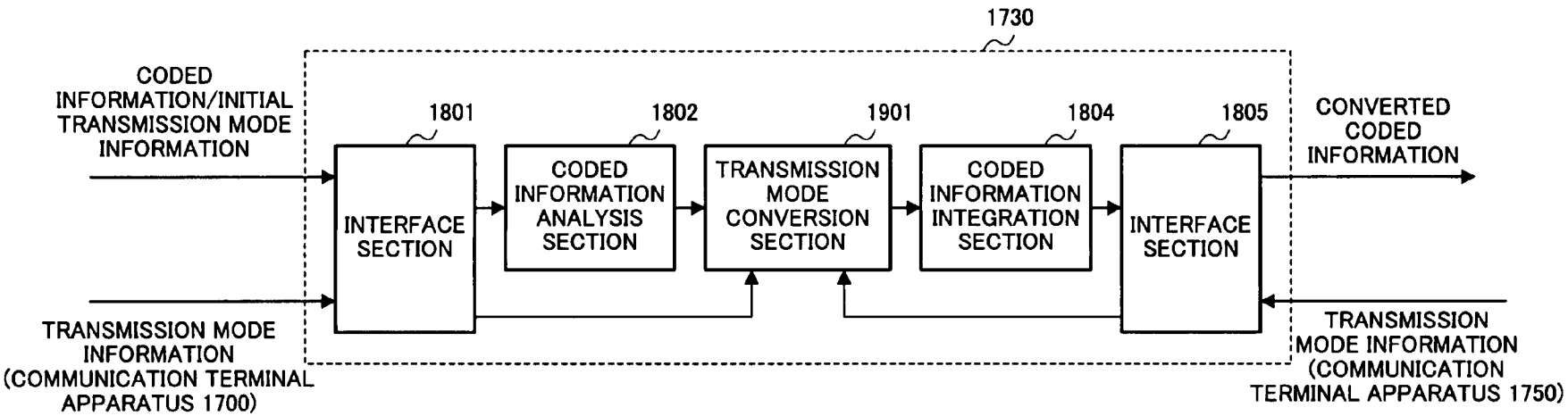
FIG. 19 is another block diagram showing the configuration of the relay station according to the above described embodiment.

FIG. 19 is a block diagram showing the configuration of relay station 1730 in this case and the operation of transmission mode conversion section 1901 is different from that of transmission mode conversion section 1803 in FIG. 18. Transmission mode conversion section 1901 performs transmission bit rate conversion processing on an information source code and initial transmission mode information mode A according to transmission mode information mode A' and transmission mode information mode B from communication terminal apparatus 1700. To be more specific, when initial transmission mode information mode A is bitrate 1, transmission mode information mode B is $bitrate_{high}$ and transmission mode information mode A' is $bitrate_{high}$, transmission mode conversion section 1901 changes initial transmission mode information mode A to bitrate 2 and outputs base layer information source code, first enhancement layer information source code and initial transmission mode information mode A to coded information integration section 1804. Furthermore, when initial transmission mode information mode A is bitrate 1, transmission mode information mode B is $bitrate_{low}$ and transmission mode information mode A' is $bitrate_{low}$, transmission mode conversion section 1901 changes initial transmission mode information mode A to bitrate 2 and outputs the base layer information source code, first enhancement layer information source code and initial transmission mode information mode A to coded information integration section 1804. Furthermore, when initial transmission mode information mode A is bitrate 1, transmission mode information mode B is $bitrate_{low}$, and transmission mode information mode A' is $bitrate_{high}$, transmission mode conversion section 1901 changes initial transmission mode information mode A to bitrate 3 and outputs base layer information source code and initial transmission mode information mode A to coded information integration section 1804. Furthermore, when initial transmission mode information mode A is bitrate 2, transmission mode information mode B is $bitrate_{low}$ and transmission mode information mode A' is $bitrate_{high}$, transmission mode conversion section 1901 changes initial transmission mode information mode A to bitrate 3 and outputs the base layer information source code and transmission mode information mode A to coded information integration section 1804. Furthermore, for combinations of initial transmission mode information mode A, transmission mode information mode B and transmission mode information mode A' other than those described above, transmission mode conversion section 1901 outputs the information source code and transmission mode information mode A to coded information integration section 1804 as they are.

Thus, according to this embodiment, when there is ambient noise such as sounds of running cars and trains on the receiving side and transmitting side, the relay station can also control the transmission bit rate instead of the transmitting side. This allows more flexible control of the transmission bit rate and can further improve channel efficiency.

When a certain relay station exists in transmission path 110 in an environment in which a communication of a speech/audio signal under a one-way communication scheme is being carried out according to a scalable coding scheme, combining this embodiment with above described Embodiment 3 will also allow the relay station to use transmission mode information transmitted from the communication terminal, reduce the amount of information of the coded information transmitted from the base station and retransmit it to transmission path 110.

The present application is based on Japanese Patent Application No. 2004-048569 filed on Feb. 24, 2004, entire content of which is expressly incorporated by reference herein.

INDUSTRIAL APPLICABILITY

The present invention is suitable for use in a communication terminal apparatus of a packet communication system or mobile communication system.

The invention claimed is:

1. A communication apparatus comprising:

a transmission mode determining section that determines a second transmission mode for controlling a transmission bit rate of an input signal of said communication apparatus based on a level of ambient noise included in the input signal at the communication apparatus and a first transmission mode for controlling a transmission bit rate of a signal transmitted from the communication apparatus according to a level of ambient noise included in an input signal at an apparatus of a communicating party; and a coding section that performs coding on the input signal at a transmission bit rate corresponding to said second transmission mode and transmits an information source code obtained through the coding and said second transmission mode to the apparatus of the communicating party.

2. The communication apparatus according to claim 1, wherein the transmission mode determining section calculates a maximum value and minimum value of a power value of the input signal for a predetermined time and detects the level of ambient noise included in the input signal using at least one of the maximum value and minimum value of said power value.

3. The communication apparatus according to claim 2, wherein the transmission mode determining section carries out processing of determining a transmission mode when a difference between the detected level of ambient noise and a previously detected level is greater than a predetermined threshold.

4. A communication apparatus comprising:

a decoding section that decodes an information source code obtained through coding at an apparatus of a communicating party;

a transmission mode determining section that determines a transmission mode for controlling a transmission bit rate of an input signal according to a level of ambient noise in the signal decoded at said decoding section; and a coding section that performs coding on said input signal at a transmission bit rate corresponding to the transmission mode determined at said transmission mode determining section and transmits the information source code obtained through the coding and said transmission mode to the apparatus of the communicating party.

5. A communication apparatus comprising:

a decoding section that decodes an information source code obtained through coding at an apparatus of a communicating party;

a transmission mode determining section that determines a transmission mode for controlling a transmission bit rate of an input signal based on a level of ambient noise included in said input signal and a level of ambient noise of the signal decoded at said decoding section; and a coding section that performs coding on said input signal at a transmission bit rate corresponding to the transmission mode determined at said transmission mode determining section and transmits the information source code obtained through the coding and said transmission mode to the apparatus of the communicating party.

6. A signal coding/decoding method whereby a first communication apparatus and a second communication apparatus carry out radio communication, said second communication apparatus transmits an information source code obtained by coding an input signal to said first communication apparatus and said first communication apparatus decodes said information source code, the method comprising:

at the first communication apparatus, determining a transmission mode for controlling a transmission bit rate of a signal transmitted from the second communication apparatus according to a level of ambient noise included in the input signal and transmitting said transmission mode to said second communication apparatus;

at the second communication apparatus, coding the input signal at a transmission bit rate corresponding to the transmission mode determined by said first communication apparatus and transmitting the information source code obtained through the coding to said first communication apparatus; and at the first communication apparatus, decoding the information source code at said transmission bit rate transmitted from said second communication apparatus.

* * * * *

UNITED STATES PATENT AND TRADEMARK OFFICE

CERTIFICATE OF CORRECTION

PATENT NO. : 7,653,539 B2
APPLICATION NO. : 10/590417
DATED : January 26, 2010
INVENTOR(S) : Tomofumi Yamanashi et al.

It is certified that error appears in the above-identified patent and that said Letters Patent is hereby corrected as shown below:

Title Page;
In the Letters Patent issued on January 26, 2010, Item (87), PCT publication number and publication date, reads:

"(87) PCT Pub. No.: WO2005/081232
PCT Pub. Date: Jan. 9, 2005"

and should read:

"(87) PCT Pub. No.: WO2005/081232
PCT Pub. Date: Sept. 1, 2005"

Signed and Sealed this

Fifteenth Day of June, 2010

David J. Kappos

David J. Kappos
*Director of the United States Patent and Trademark Office*